US011345557B2

(12) United States Patent
Mitamura

(10) Patent No.: US 11,345,557 B2
(45) Date of Patent: May 31, 2022

(54) SHEET FEEDING APPARATUS

(71) Applicant: CANON KABUSHIKI KAISHA, Tokyo (JP)

(72) Inventor: Akiyuki Mitamura, Inashiki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 178 days.

(21) Appl. No.: 16/889,992

(22) Filed: Jun. 2, 2020

(65) Prior Publication Data

US 2020/0385225 A1 Dec. 10, 2020

(30) Foreign Application Priority Data

Jun. 7, 2019 (JP) ..... JP2019-107290

(51) Int. Cl.
*B65H 7/02* (2006.01)
*B65H 3/06* (2006.01)
*B65H 3/52* (2006.01)

(52) U.S. Cl.
CPC ..... *B65H 7/02* (2013.01); *B65H 3/0669* (2013.01); *B65H 3/5261* (2013.01); *B65H 3/0684* (2013.01); *B65H 2513/41* (2013.01)

(58) Field of Classification Search
CPC ..... B65H 7/02; B65H 3/0669; B65H 3/5261; B65H 3/0684; B65H 2513/41
See application file for complete search history.

(56) References Cited

U.S. PATENT DOCUMENTS

| | | | | |
|---|---|---|---|---|
| 7,905,484 | B2 * | 3/2011 | Komuro | B65H 3/5261 271/262 |
| 8,038,140 | B2 * | 10/2011 | Kimura | B65H 3/0684 271/4.03 |
| 10,562,724 | B2 * | 2/2020 | Kawamura | B65H 3/06 |
| 10,676,300 | B2 * | 6/2020 | Nakajima | B65H 3/5261 |
| 2010/0148423 | A1 * | 6/2010 | Morita | B65H 5/062 271/10.03 |
| 2019/0144220 | A1 * | 5/2019 | Sakurai | B65H 7/02 271/121 |
| 2020/0231395 | A1 | 7/2020 | Mitamura | |

FOREIGN PATENT DOCUMENTS

| | | | | |
|---|---|---|---|---|
| JP | 2014-177326 A | | 9/2014 | |
| JP | 2016-113301 A | | 6/2016 | |
| JP | 2017222474 A | * | 12/2017 | B65H 3/52 |

* cited by examiner

*Primary Examiner* — Howard J Sanders
(74) *Attorney, Agent, or Firm* — Venable LLP

(57) ABSTRACT

In a first mode, the control unit controls the driving source such that the rotary feeding member starts to move toward the first position based on an elapse of a first time since the detection portion detected a leading edge of the sheet, and positions the rotary feeding member at the first position when a trailing edge of the sheet passes through the separation nip. In a second mode, the control unit controls the driving source such that the rotary feeding member starts to move toward the first position based on an elapse of a second time longer than the first time since the detection portion detected the leading edge of the sheet, and positions the rotary feeding member at a position separated more from the stacking portion than the first position when the trailing edge of the sheet passes through the separation nip.

20 Claims, 20 Drawing Sheets

SHEET FEEDING APPARATUS

BACKGROUND OF THE INVENTION

Field of the Invention

The present invention relates to a sheet feeding apparatus for feeding sheets.

Description of the Related Art

In general, an automatic document feeder (ADF) for feeding documents and a cassette-type feeding apparatus cause a separation portion to separate a sheet from others one by one after causing a pickup roller to feed the sheet. However, if multi-feeding occurs, a plurality of sheets may be fed into the separation portion by the pickup roller.

As countermeasures to this, Japanese Patent Application Publication No. 2014-177326 proposes a feeding apparatus that keeps a pickup roller in contact with a sheet on a sheet feeding plate when the apparatus does not detect the multi-feeding, and separates the pickup roller from the sheet on the sheet feeding plate when the apparatus detects the multi-feeding. In addition, Japanese Patent Application Publication No. 2016-113301 proposes a document reading apparatus that has a normal mode for reading a document with a predetermined sheet thickness and a thin-sheet mode for reading a thin sheet. In the thin-sheet mode, the document reading apparatus conveys a document at a document feeding speed lower than that in the normal mode.

The separation portion described in Japanese Patent Application Publication Nos. 2014-177326 and 2016-113301 includes a feed roller and a separation roller. The separation roller is in contact with the feed roller, and is coupled with a torque limiter. When the separation roller is rotated by the rotation of the feed roller, a holder member that supports the separation roller is slightly displaced in a sheet conveyance direction by a working of the torque limiter. In this case, when the trailing edge of a sheet passes through the separation portion, the holder member returns to its original position due to its rigidity.

Since the holder member moves in this manner, the separation roller supported by the holder member pushes back the following sheet held by the separation portion, in the sheet conveyance direction. As a result, a loop may be formed in the following sheet. If a plurality of sheets is conveyed, and a loop in a following sheet grows larger than a predetermined size, failure in conveyance of sheets, such as jamming, and damage to the sheets, such as wrinkles, may be caused.

SUMMARY OF THE INVENTION

According to a first aspect of the present invention, a sheet feeding apparatus includes a stacking portion on which a sheet is stacked, a rotary feeding member configured to feed the sheet stacked on the stacking portion, a rotary conveyance member configured to convey the sheet, fed by the rotary feeding member, in a conveyance direction, a rotary separation member configured to form a separation nip together with the rotary conveyance member, and configured to be rotated by rotation of the rotary conveyance member with a predetermined load torque in a case where the sheet is conveyed by the separation nip in the conveyance direction, the separation nip being configured to separate the sheet from another sheet, a supporting portion configured to rotatably support the rotary feeding member, a driving source configured to drive the supporting portion such that the rotary feeding member moves between a first position and a second position, the first position being a position at which the rotary feeding member abuts against the sheet stacked on the stacking portion, the second position being a position at which the rotary feeding member is separated from the sheet stacked on the stacking portion, a detection portion configured to detect the sheet in a position positioned downstream of the separation nip, and a control unit configured to control the driving source. The control unit is configured to execute a first mode and a second mode. In the first mode, the control unit is configured to control the driving source such that the rotary feeding member starts to move toward the first position based on an elapse of a first time since the detection portion detected a leading edge of the sheet, and position the rotary feeding member at the first position when a trailing edge of the sheet passes through the separation nip. In the second mode, the control unit is configured to control the driving source such that the rotary feeding member starts to move toward the first position based on an elapse of a second time longer than the first time since the detection portion detected the leading edge of the sheet, and position the rotary feeding member at a position separated more from the stacking portion than the first position when the trailing edge of the sheet passes through the separation nip.

According to a second aspect of the present invention, a sheet feeding apparatus includes a stacking portion on which a sheet is stacked, a rotary feeding member configured to feed the sheet stacked on the stacking portion, a rotary conveyance member configured to convey the sheet, fed by the rotary feeding member, in a conveyance direction, a rotary separation member configured to form a separation nip together with the rotary conveyance member, and configured to be rotated by rotation of the rotary conveyance member with a predetermined load torque in a case where the sheet is conveyed by the separation nip in the conveyance direction, the separation nip being configured to separate the sheet from another sheet, a supporting portion configured to rotatably support the rotary feeding member, a driving source configured to drive the supporting portion such that the rotary feeding member moves between a first position and a second position, the first position being a position at which the rotary feeding member abuts against the sheet stacked on the stacking portion, the second position being a position at which the rotary feeding member is separated from the sheet stacked on the stacking portion, a detection portion configured to detect the sheet in a position positioned downstream of the separation nip, and a control unit configured to control the driving source. The control unit is configured to execute a third mode and a fourth mode. In the third mode, the control unit is configured to control the driving source such that the rotary feeding member is positioned at the first position in a period of time from when the rotary feeding member starts to feed the sheet until when a trailing edge of the sheet passes through the separation nip, and position the rotary feeding member at the first position when the trailing edge of the sheet passes through the separation nip. In the fourth mode, the control unit is configured to control the driving source such that the rotary feeding member starts to move toward the second position based on an elapse of a third time since the detection portion detected a leading edge of the sheet, control the driving source such that the rotary feeding member starts to move toward the first position based on an elapse of a fourth time longer than the third time since the detection portion detected the leading edge of the sheet, and position the rotary feeding member at a position separated more from the stacking portion than the first position when the trailing edge of the sheet passes through the separation nip.

Further features of the present invention will become apparent from the following description of exemplary embodiments with reference to the attached drawings.

DESCRIPTION OF THE EMBODIMENTS

First Embodiment

Overall Configuration

Figure 1A:
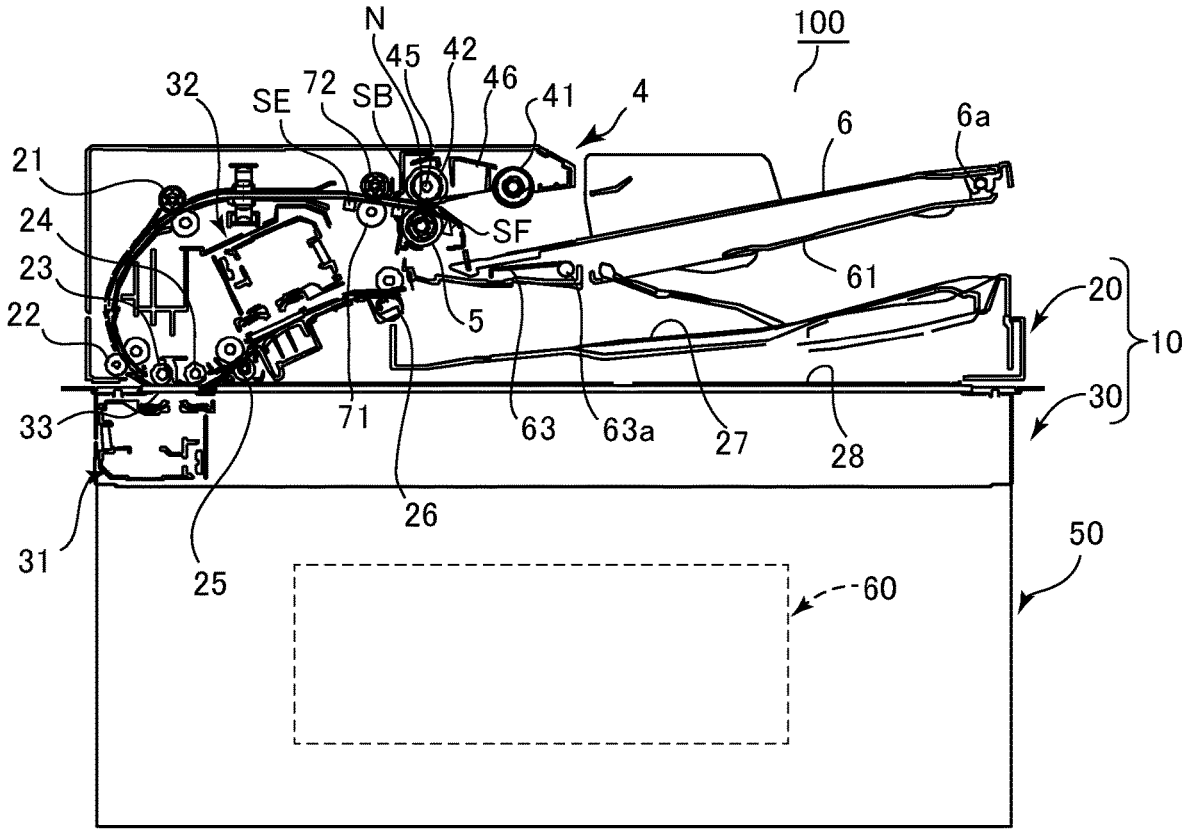
FIG. 1A is an overall schematic diagram illustrating a printer of a first embodiment.

First, a first embodiment of the present invention will be described. A printer 100 of the first embodiment, which serves as an image forming apparatus, is an electrophotographic laser-beam printer. As illustrated in FIG. 1A, the printer 100 includes a printer body 50 and an image reading apparatus 10 attached to a top portion of the printer body 50. In the following description, a sheet may be a plain paper sheet, a specialized paper sheet such as a coated paper sheet, an envelope, a recording material which has a specialized shape and which may be an index paper sheet, a plastic film used for overhead projectors, or a cloth sheet. A document is also one example of a sheet.

Figure 1B:
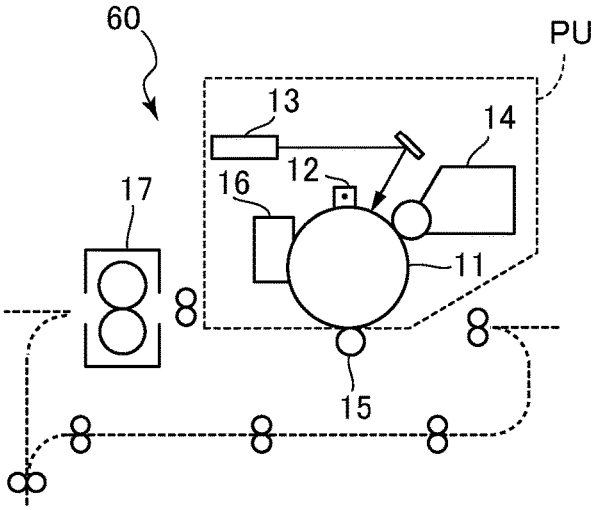
FIG. 1B is a schematic diagram illustrating an image forming engine.

The printer body 50 contains an image forming engine 60. As illustrated in FIG. 1B, the image forming engine 60 includes an image forming unit PU and a fixing apparatus 17. The image forming unit PU serves as an electrophotographic image forming portion. When the start of an image forming operation is instructed, a photosensitive drum 11 that is a photosensitive member rotates, and the surface of the photosensitive drum 11 is uniformly charged by a charging roller 12. Then an exposure apparatus 13 modulates and outputs a laser beam in accordance with image data, sent by the image reading apparatus 10 or an external computer, so that the exposure apparatus 13 scans the surface of the photosensitive drum 11 with the modulated laser beam for forming an electrostatic latent image on the photosensitive drum 11. The electrostatic latent image is visualized (developed) into a toner image, with toner supplied from a developing apparatus 14.

In parallel with such an image forming operation, a feeding operation is performed for feeding a sheet stacked on a cassette or a manual feed tray (both not illustrated) toward the image forming engine 60. The sheet is conveyed in synchronization with the image formation operation performed by the image forming unit PU. The toner image borne by the photosensitive drum 11 is transferred onto the sheet by a transfer roller 15. The toner left on the photosensitive drum 11 after the toner image is transferred is collected by a cleaning apparatus 16. The sheet onto which the toner image (still not fixed to the sheet) has been transferred is delivered to the fixing apparatus 17, and heated and pressurized by a roller pair while held by the roller pair. Thus, the toner is melted and solidified, and the toner image is fixed to the sheet. Then the sheet is discharged by a discharging portion such as a discharging roller pair.

Image Reading Apparatus

Next, the image reading apparatus 10 will be described in detail. As illustrated in FIG. 1A, the image reading apparatus 10 includes an ADF 20 (automatic document feeder) and a reading unit 30. The ADF 20 serves as a sheet feeding apparatus, and feeds a document stacked on a document tray 6 and discharges the document onto a discharging tray 27. The reading unit 30 reads the document conveyed by the ADF 20. The document tray 6 serves as a stacking portion, and is supported so as to be able to pivot on a pivot shaft 6*a* with respect to a tray supporting member 61. The tray supporting member 61 is supported such that the tray supporting member 61 can pivot a lifter 63 on a pivot shaft 63*a*. When the lifter 63 pivots upward, the document tray 6 pivots upward on the pivot shaft 6*a*. Note that the lifter 63 may not be provided and the document tray 6 may be pivoted on the pivot shaft 6*a* by a gear or the like.

The ADF 20 is supported by a hinge such that the ADF 20 can pivot with respect to the reading unit 30 for exposing a document glass 28. Note that a document, which is one example of the sheet, may be a blank sheet or a sheet which has an image formed on a single side or both sides of the sheet.

The ADF 20 includes a feeding unit 4, a separation roller 5, drawing rollers 71 and 72, a registration roller pair 21, conveyance roller pairs 22 and 25, platen guide rollers 23 and 24, a discharging roller pair 26, and a second reading portion 32. A feed roller 42 of the feeding unit 4, and the separation roller 5 form a separation nip N in which a document is separated from others one by one. In addition, the ADF 20 includes a document sensor SS (see FIG. 3), a pre-separation sensor SF, a post-separation sensor SB, and an entrance sensor SE. The document sensor SS detects the document placed on the document tray 6.

Figure 3:
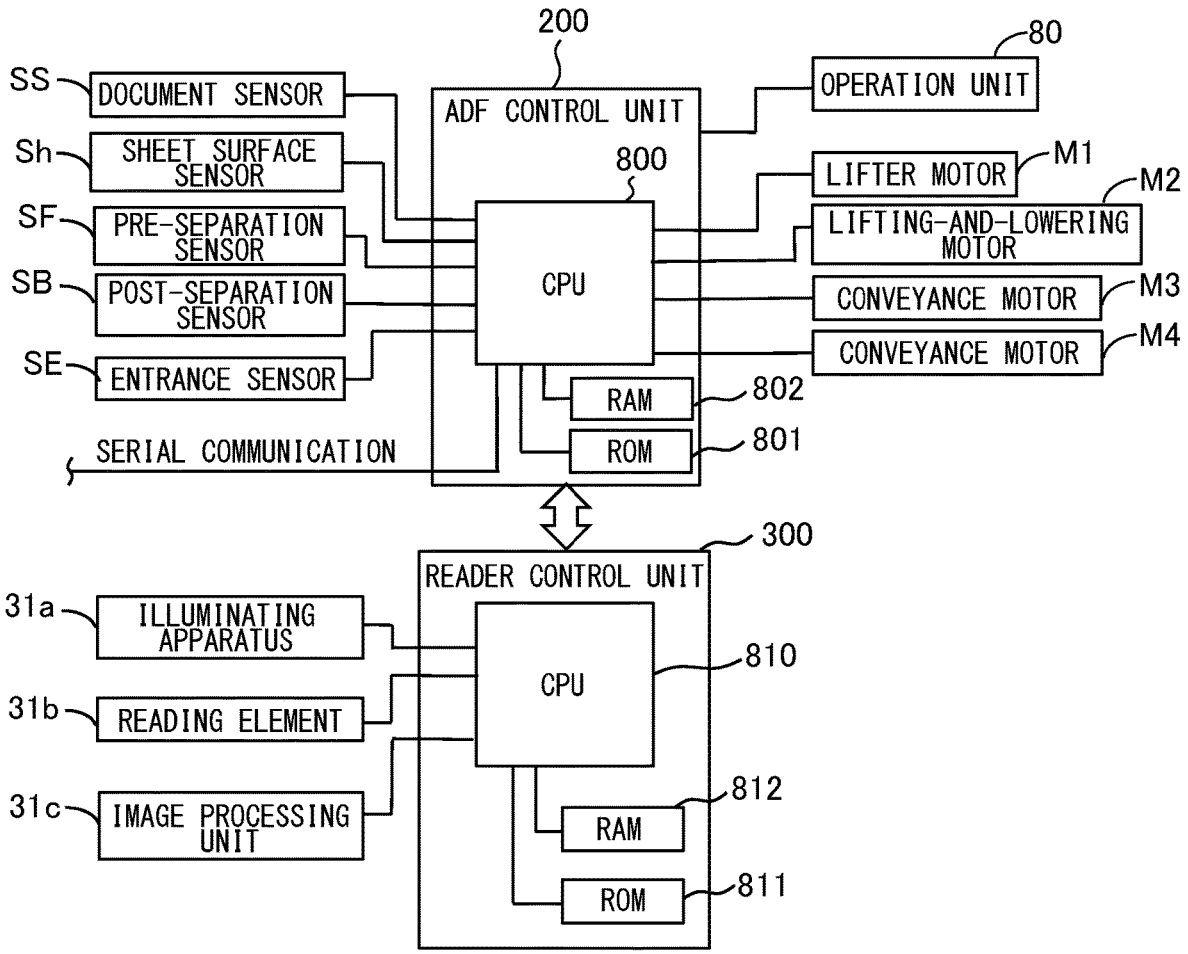
FIG. 3 is a block diagram illustrating a control system of the first embodiment.

The reading unit 30 includes a platen glass 33, a document glass 28, and a first reading portion 31 that serves as a reading portion. As illustrated in FIG. 3, the first reading portion 31 contains an illuminating apparatus 31*a*, a reading element 31*b*, an image processing unit 31*c*, and a lens and a mirror (both not illustrated). Note that the second reading portion 32 also contains an illuminating apparatus, a reading element, an image processing unit, and a mirror and a lens, although these components are not illustrated in the figure. The first reading portion 31 can be moved by a wire and a driving motor (both not illustrated) in a sub-scanning direction, which is a horizontal direction in FIG. 1A. Note that the illuminating apparatus may be an illuminating device such as a xenon lamp or an LED, and that the reading element may be a photoelectric conversion element such as a CCD or CMOS sensor.

The image reading apparatus 10 reads image information from the document D in a flowing-document read mode or a fixed-document read mode. In the flowing-document read mode, the document D is stacked on the document tray 6, and the image reading apparatus 10 scans the document D while causing the ADF 20 to feed the document D. In the fixed-document read mode, the image reading apparatus 10 scans the document D placed on the document glass 28. The flowing-document read mode is selected when the document sensor SS detects the document D stacked on the document tray 6, or when a user explicitly selects the flowing-document read mode by using, for example, an operation panel of the printer body 50.

When the flowing-document read mode is executed, a document is conveyed while separated from others one by one, by the feeding unit 4 and the separation roller 5. The document is further conveyed by the drawing rollers 71 and 72, and abuts against the registration roller pair 21 that is in a stop state. The registration roller pair 21 corrects the skew of the document, and further conveys the document toward the conveyance roller pair 22. The conveyance roller pair 22 conveys the document toward the platen glass 33. When passing the platen glass 33, the document is guided by the platen guide rollers 23 and 24 so as not to float up from the platen glass 33.

In this time, an image on a first surface (front surface) of the document is read by the first reading portion 31 through the platen glass 33. Specifically, light is emitted from the illuminating apparatus 31*a* to the document that is being conveyed, and light reflected from the document is guided to the lens via the mirror. The light passes through the lens, and forms an image on the reading element 31*b*. The reading element 31*b* performs photoelectric conversion on the image, and sends corresponding image information data to the CPU. After passing the platen glass 33, the document is guided to the conveyance roller pair 25. While the document is being conveyed by the conveyance roller pair 25, an image on a second surface (back surface) of the document is read by the second reading portion 32. Note that images on both sides of the document may not necessarily be read, and an image on one of the first and the second surfaces of the document may be read. After the image of the document is read, the document is discharged onto the discharging tray 27 by the discharging roller pair 26.

On the other hand, the fixed-document read mode is selected when the apparatus detects the document placed on the document glass 28, or when a user explicitly selects the fixed-document read mode by using, for example, an operation panel of the printer body 50. In this case, the document D on the document glass 28 does not move, and the first reading portion 31 moves along the document glass 28. In this manner, the document is scanned with the light emitted from the illuminating apparatus 31*a*. The reading element 31*b* performs the photoelectric conversion, and sends corresponding image information data to the CPU.

Feeding Unit

Figure 2:
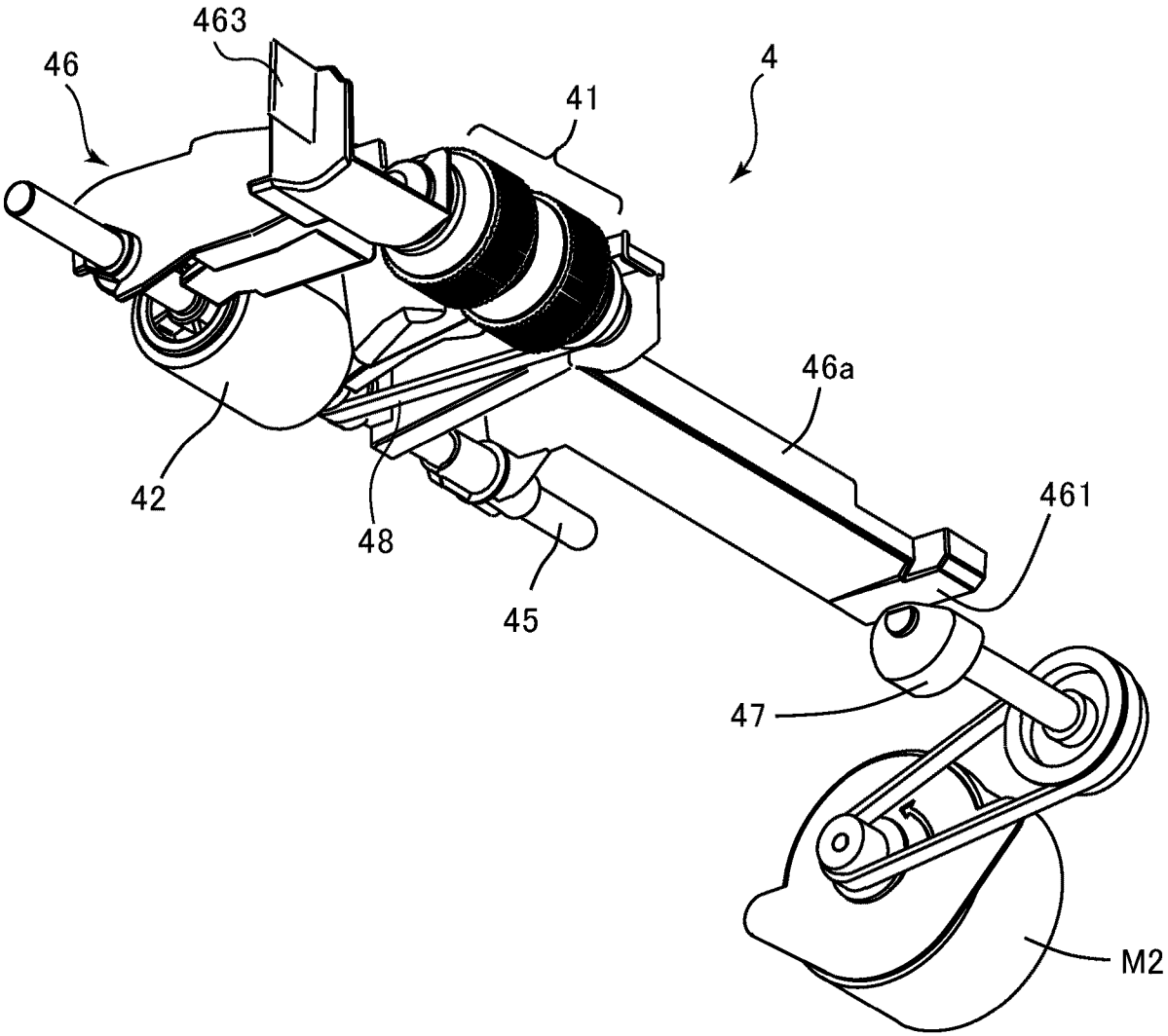
FIG. 2 is a perspective view illustrating a feeding unit.

Next, a configuration of the feeding unit 4 will be described with reference to FIG. 2. As illustrated in FIG. 2, the feeding unit 4 includes a feed roller shaft 45, the feed roller 42, and a pickup roller 41. The feed roller 42 is rotatably supported by the feed roller shaft 45, and serves as a rotary conveyance member. The pickup roller 41 serves as a rotary feeding member. In addition, the feeding unit 4 also includes a holder unit 46 and a swing arm 46*a*. The holder unit 46 is pivotably supported by the feed roller shaft 45, and supports the pickup roller 41 such that the pickup roller 41 can rotate. The swing arm 46*a* is disposed in the holder unit 46, and extends in the width direction of the document.

The pickup roller 41 includes two roller members, and rotates when the torque of the feed roller shaft 45 is transmitted to the pickup roller 41 via a belt member 48. In addition, a torque limiter (not illustrated) is interposed between the pickup roller 41 and a rotation shaft of the pickup roller 41. Thus, the pickup roller 41 can be rotated by the document conveyed by rollers disposed downstream from the pickup roller 41 in the conveyance direction.

In addition, a cam follower 461 is formed at an end portion of the swing arm 46*a* in the width direction of the swing arm 46*a*. The cam follower 461 is in contact with a cam 47, which is rotated by a lifting-and-lowering motor M2. The cam 47 is formed in a nearly semicircular shape, and the cam follower 461 of the swing arm 46*a* is moved by the movement of a cam surface of the cam 47 when the cam 47 rotates. Thus, when the cam 47 rotates, the holder unit 46 and the pickup roller 41 pivot on the feed roller shaft 45. In this manner, the pickup roller 41 moves in a predetermined area including a feed position and a separation position. The feed position is a first position at which the pickup roller 41 abuts against a document stacked on the document tray 6. The separation position is a second position at which the pickup roller 41 is separated from the document stacked on the document tray 6.

The holder unit 46 serves as a supporting portion, and has a portion 463 to be detected for detecting the position of the pickup roller 41. The portion 463 is formed on the holder unit 46, adjacent to the pickup roller 41 in the width direction. The position of the portion 463 is detected by a sheet surface sensor Sh (see FIG. 3).

Control System

FIG. 3 is a block diagram illustrating a control system of the present embodiment. As illustrated in FIG. 3, the ADF 20 includes an ADF control unit 200, and the reading unit 30 includes a reader control unit 300. The ADF control unit 200 serves as a control unit, and includes a CPU 800, a ROM 801, and a RAM 802. The CPU 800 executes a program stored in the ROM 801. The RAM 802 is used as a work area of the CPU 800. The reader control unit 300 includes a CPU 810, a ROM 811, and a RAM 812. The CPU 810 executes a program stored in the ROM 811. The RAM 812 is used as a work area of the CPU 810.

On the input side of the ADF control unit 200, the ADF control unit 200 is connected with the document sensor SS, the sheet surface sensor Sh, the pre-separation sensor SF, the post-separation sensor SB, and the entrance sensor SE. The document sensor SS detects a document stacked on the document tray 6. The sheet surface sensor Sh detects the portion 463 of the holder unit 46, and thereby detects the position of the pickup roller 41. The pre-separation sensor SF detects a document at a position positioned upstream from the separation nip N in the conveyance direction of the document. The post-separation sensor SB detects a document at a position positioned downstream from the separation nip N in the conveyance direction. The entrance sensor SE detects a document at a position positioned downstream from the drawing rollers 71 and 72 in the conveyance direction. That is, the entrance sensor SE serves as a detection portion, and detects a document at the position positioned downstream from the separation nip N in the conveyance direction. The conveyance information on the document detected the above-described sensors is temporarily stored in the RAM 802.

On the output side of the ADF control unit 200, the ADF control unit 200 is connected with a lifter motor M1, the lifting-and-lowering motor M2, and conveyance motors M3 and M4. The lifter motor M1 drives the lifter 63, and the lifting-and-lowering motor M2 drives the cam 47. The conveyance motor M3, which serves as a driving source, drives the feed roller shaft 45, and thereby drives the pickup roller 41, the feed roller 42, and the drawing roller 71. The conveyance motor M4 drives the registration roller pair 21, the conveyance roller pairs 22 and 25, and the discharging roller pair 26. The timing for driving the lifting-and-lowering motor M2 and the conveyance motors M3 and M4 is adjusted in accordance with the conveyance information on the document temporarily stored in the RAM 802, so that the document conveyance speed of the ADF 20 is controlled. In addition, the ADF control unit 200 is connected with an operation unit 80. The operation unit 80 includes an operation panel that displays various types of information, and buttons including a start button to start a copy job.

Conveyance Sequence of ADF

Next, one example of a conveyance sequence of the ADF 20 will be described with reference to the flowchart of FIG. 4. When the conveyance sequence of the ADF 20 is started, the ADF control unit 200 determines whether a document is placed on the document tray 6, depending on a detection result by the document sensor SS (Step S1). If the ADF control unit 200 determines that the document is placed (Step S1: YES), then the ADF control unit 200 determines whether a job, such as a copy job, that involves the conveyance of the document is given (Step S2).

If the ADF control unit 200 determines that the job is given (Step S2: YES), then the ADF control unit 200 drives the lifting-and-lowering motor M2 for a predetermined time for rotating the cam 47, and thereby lowers the pickup roller 41 (Step S3). In this operation, since the portion 463 of the holder unit 46 is lowered, the sheet surface sensor Sh turns off. The ADF control unit 200 then drives the lifter motor M1 for lifting the lifter 63, and thereby lifts the document tray 6 (Step S4).

While the document tray 6 is lifted, the document stacked on the document tray 6 contacts the pickup roller 41. After that, the document tray 6 is further lifted, pushing up the pickup roller 41 and the holder unit 46. If the sheet surface sensor Sh detects the portion 463 and turns on (Step S5: YES), then the ADF control unit 200 stops the lifter motor M1 (Step S6). With this operation, the pickup roller 41 is positioned at the feed position at which the pickup roller 41 can feed the document.

Then the ADF control unit 200 drives the conveyance motors M3 and M4, and executes feeding control for feeding the document on the document tray 6 (Step S7). The lifting-and-lowering control for the pickup roller 41 performed in the feeding control will be described later. The feeding control is repeated until all the documents stacked on the document tray 6 are fed, or until a predetermined number of documents is fed. The predetermined number of documents is specified in the job. That is, if the job has been completed, or if the last document on the document tray 6 has been fed (Step S8: YES), then the ADF control unit 200 stops the feeding operation (Step S9). Then the ADF control unit 200 drives the lifter motor M1 for positioning the document tray 6 at a lowered position, and drives the lifting-and-lowering motor M2 for lifting the pickup roller 41 to a separation position (Step S10 and S11). With this operation, the ADF 20 allows other documents to be placed on the document tray 6, and completes the conveyance sequence of the ADF 20.

First Mode

Figure 4:
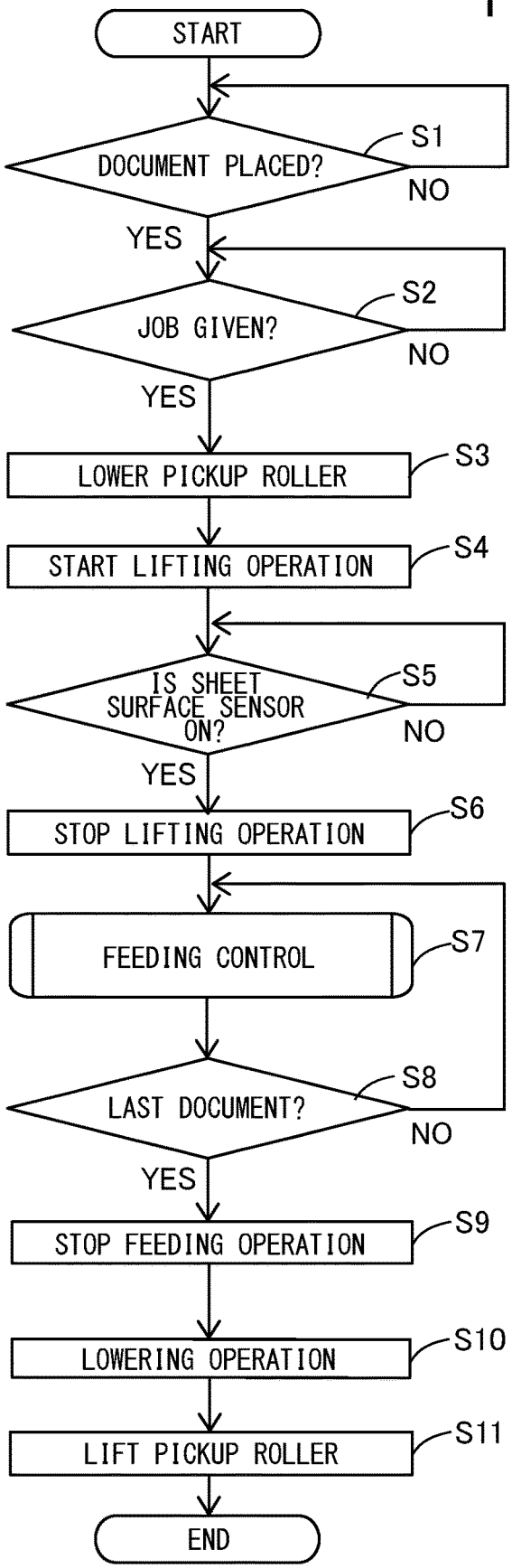
FIG. 4 is a flowchart illustrating one example of a conveyance sequence of an ADF.

In the present embodiment, the feeding control of Step S7 of FIG. 4 is executed selectively in a later-described first mode or second mode, for lifting and lowering the pickup roller 41. Either the first mode or the second mode is selected by a user operating the operation unit 80 or an external computer before the job is given. When the job is given, a selected mode will be executed.

Figure 5:
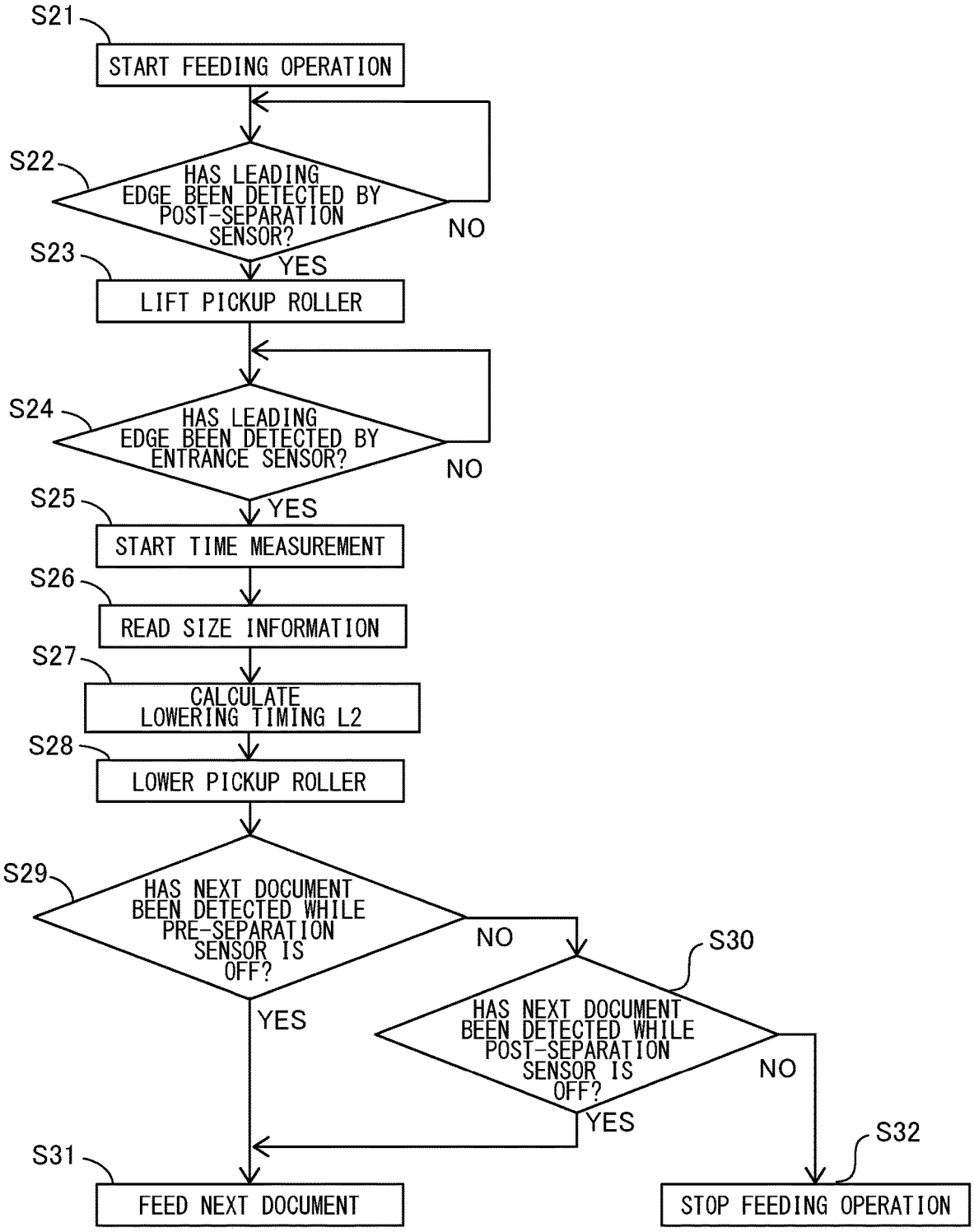
FIG. 5 is a flowchart illustrating processes of a first mode.
Figure 6:
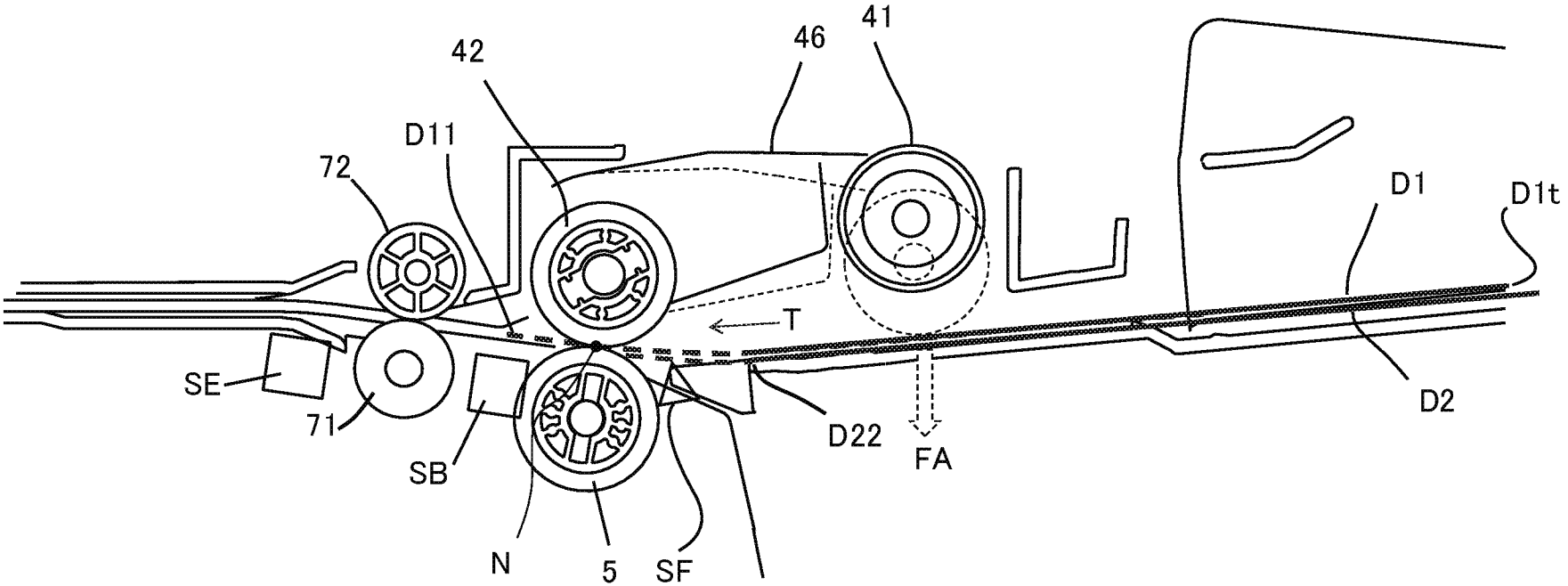
FIG. 6 is a sectional view for illustrating a timing for lowering a pickup roller.

First, the first mode will be described with reference to FIGS. 5 to 7. As illustrated in FIG. 5, in the first mode, the ADF control unit 200 drives the conveyance motors M3 and M4, and causes the pickup roller 41 to start the conveyance of documents. Then, a first document D1 that is an uppermost document stacked on the document tray 6 is fed in a conveyance direction T, as illustrated in FIG. 6. Then, a leading edge D11 of the first document D1 reaches a position indicated by a broken line of FIG. 6, and is detected by the post-separation sensor SB.

If the leading edge D11 of the first document D1 is detected by the post-separation sensor SB (Step S22: YES), then the ADF control unit 200 controls the lifting-and-lowering motor M2, and thereby lifts the holder unit 46 and the pickup roller 41 (Step S23). More specifically, the pickup roller 41 is lifted from a feed position indicated by a broken line of FIG. 6, to a separation position indicated by a solid line of FIG. 6.

Even when the pickup roller 41 is lifted to the separation position and separated from the first document D1, the first document D1 is conveyed downstream in the conveyance direction T by the separation nip N and the drawing rollers 71 and 72. If the leading edge D11 of the first document D1 (that is a sheet) is detected by the entrance sensor SE (Step S24: YES), then the ADF control unit 200 starts time measurement (Step S25). Note that the ADF control unit 200 may measure the conveyance distance of the first document D1, instead of measuring time.

Then the ADF control unit 200 reads size information on the first document D1 that is temporarily stored in the RAM 802 (Step S26), and calculates a lowering timing L2 for lowering the pickup roller 41 based on the size information (Step S27). The lowering timing L2 is a point of time at which a first time has elapsed since the start of the time measurement in Step S25. The size of the first document D1 may be inputted by a user through the operation unit 80 or an external computer, or may be detected on the document tray 6.

For example, on the document tray 6, a pair of regulation members and a sensor are disposed. The regulation members are disposed at edge portions of documents (stacked on the document tray 6) in the width direction of the documents for regulating the position of the documents, and the sensor is a volume sensor or the like that detects the position of the pair of regulation members. Thus, the size of the documents stacked on the document tray 6 is determined from a detection result obtained by the sensor. Note that the size of the documents stacked on the document tray 6 may be determined by using one sensor that detects a size of the documents in the conveyance direction, and another sensor that detects a size of the documents in the width direction.

The lowering timing L2 is a predicted timing at which a trailing edge D1*t* of the first document D1 will pass a point directly below the pickup roller 41 located at the separation position. At the lowering timing L2, the ADF control unit 200 controls the lifting-and-lowering motor M2, and starts to lower the pickup roller 41 from the separation position toward the feed position (Step S28). The pickup roller 41 is lowered, and abuts against a second document D2 that is a sheet following the first document D1 (preceding sheet). The conveyance motor M3 is stopped before the pickup roller 41 abuts against the second document D2. In addition, in the first mode, the pickup roller 41 abuts against the second document D2 before the trailing edge D1*t* of the first document D1 passes through the separation nip N. That is, when the trailing edge D1*t* of the first document D1 passes through the separation nip N, the pickup roller 41 is in contact with the second document D2, and is located at the feed position.

Since the pickup roller 41 abuts against the second document D2 at such a timing, a detection result by the pre-separation sensor SF, disposed upstream from the separation nip N, can be used as a trigger for starting to feed the second document D2. That is, if the trailing edge D1*t* of the first document D1 passes the pre-separation sensor SF and the pre-separation sensor SF turns off, then the ADF control unit 200 determines whether the second document D2 is detected by the document sensor SS (Step S29). If the second document D2 is detected (Step S29: YES), then the ADF control unit 200 drives the conveyance motors M3 and M4, and conveys the second document D2 (Step S31). Thus, since the ADF control unit 200 lowers the pickup roller 41 at the lowering timing L2 and feeds the following document, the interval between the preceding document and the following document can be shortened, and the throughput can be increased.

Figure 7:
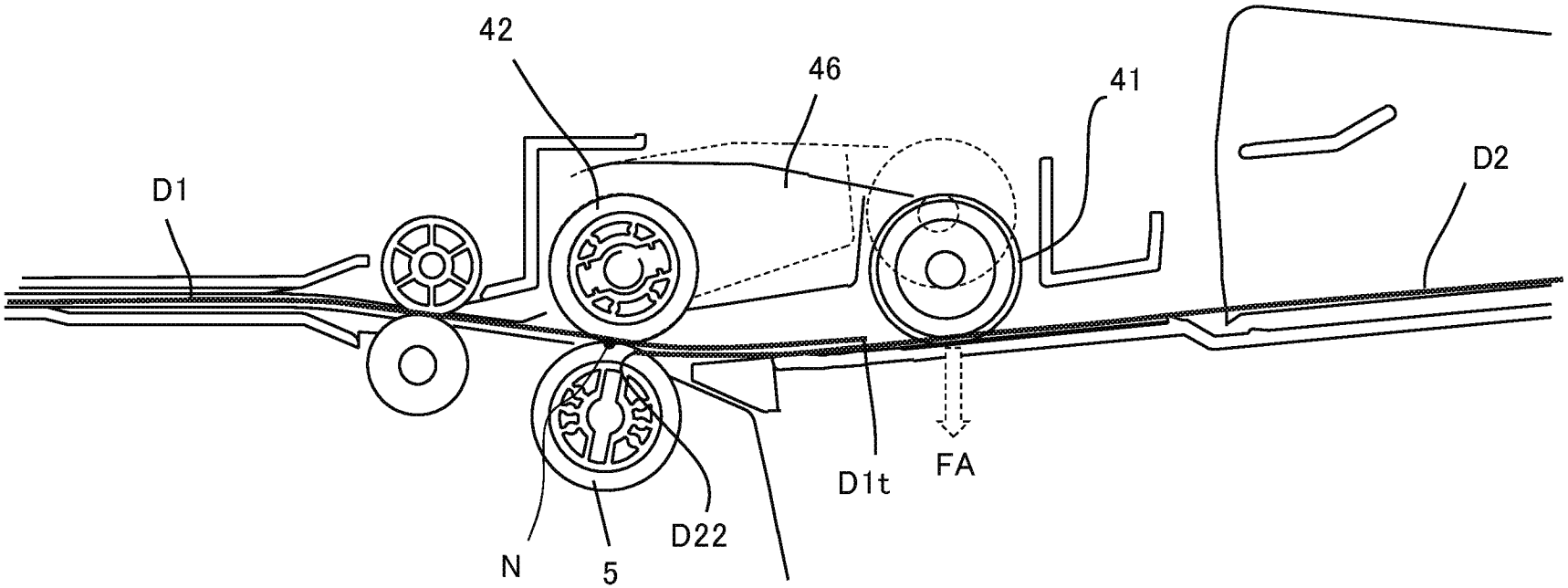
FIG. 7 is a sectional view for illustrating the timing for lowering the pickup roller.

However, as illustrated in FIG. 7, there is a case in which the following second document D2 is fed together with the first document D1. In this case, a leading edge D22 of the second document D2 may enter the separation nip N. In particular, a thin sheet with a small grammage or a narrow sheet with a small width tends to be easily fed together with the preceding document. In addition, there is a case in which a plurality of following documents enters the separation nip N.

In this case, when a pressing force FA is applied to the first document D1 by the pickup roller 41, the first document D1 is conveyed by the frictional force between the pickup roller 41 and the first document D1, whereas the second document D2 is conveyed by the frictional force between the first document D1 and the second document D2. Thus, the thin sheet or the narrow sheet, which has less weight, is easily fed together with the first document D1 by the frictional force.

In the case where the second document D2 is fed together with the first document D1 and enters the separation nip N, even though the trailing edge D1*t* of the first document D1 has passed the pre-separation sensor SF, the pre-separation sensor SF will uninterruptedly detect the second document D2 serving as a following or next document. Consequently, the pre-separation sensor SF keeps its ON state (Step S29: NO). If the post-separation sensor SB turns off, then the ADF control unit 200 determines whether the second document D2 is detected by the document sensor SS (Step S30).

If the second document D2 is detected (Step S30: YES), then the ADF control unit 200 drives the conveyance motors M3 and M4, and conveys the second document D2 (Step S31). In contrast, if the second document D2 is not detected (Step S30: NO), then the ADF control unit 200 stops the conveyance motors M3 and M4, and stops the document feeding operation (Step S32).

Mechanism of Return Behavior

Figure 8:
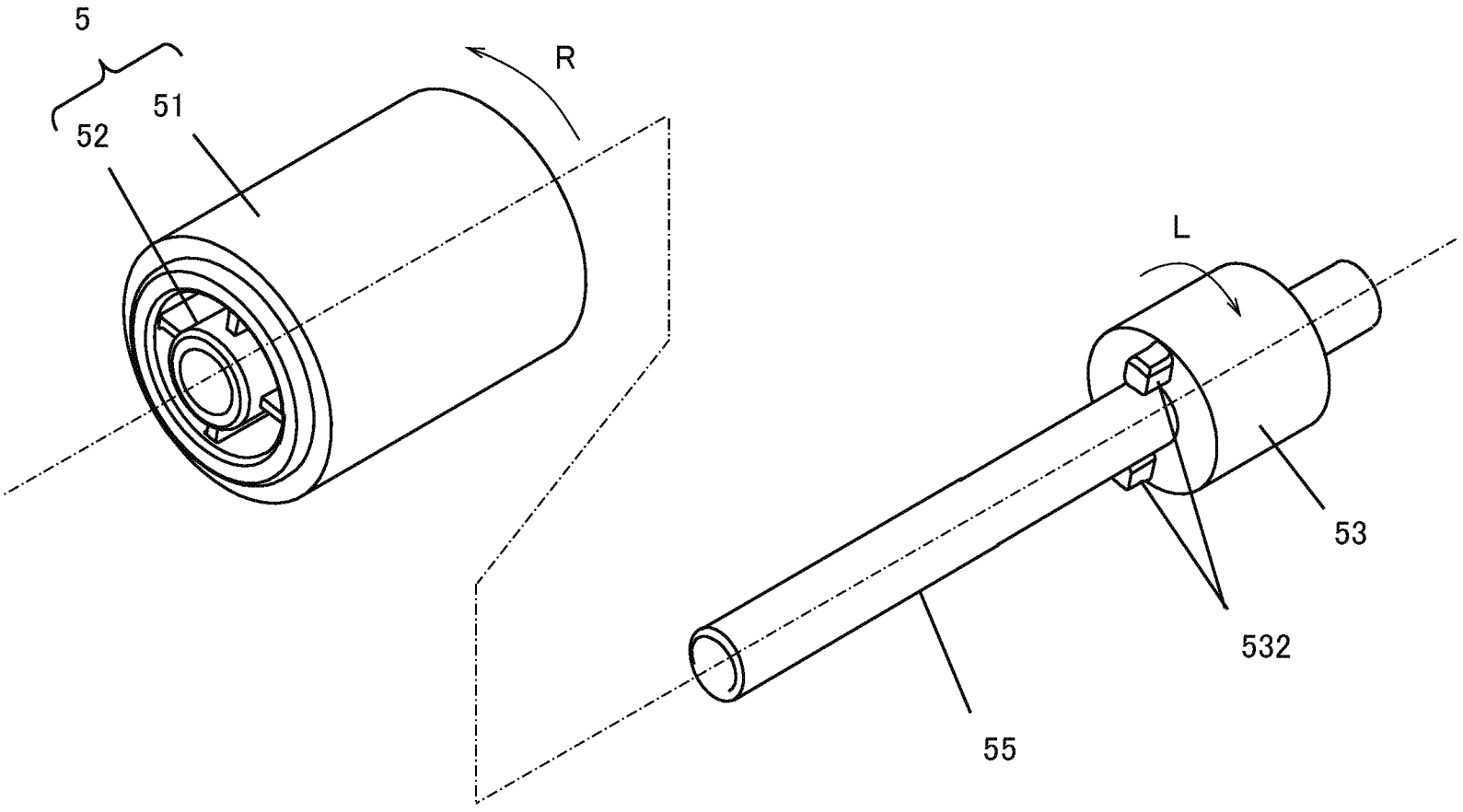
FIG. 8 is a perspective view illustrating a separation roller and a torque limiter.

Next, return behavior will be described. The separation roller 5 is displaced downstream in the conveyance direction when a document passes though the separation nip N, and returns to its original position when the trailing edge of the document passes through the separation nip N. As illustrated in FIG. 8, the separation roller 5 serves as a rotary separation member, and includes a collar 52 and a roller portion 51. The roller portion 51 is attached to the outer circumferential surface of the collar 52, and the collar 52 is formed so that a shaft 55 is inserted into the collar 52. The shaft 55 is supported so as not to rotate with respect to a later-described holder 56 (see FIG. 9). In addition, a torque limiter 53 is attached to the shaft 55. The torque limiter 53 has engagement portions 532, which project from a side surface of the torque limiter 53. The engagement portions 532 engage with the collar 52 of the separation roller 5.

When the separation roller 5 is rotated by the rotation of the feed roller 42 in a direction indicated by an arrow R in a state where a document is sandwiched between the feed roller 42 and the separation roller 5, a load torque is produced by the torque limiter 53 in a direction indicated by an arrow L. That is, the separation roller 5 is rotated by the rotation of the feed roller 42 with a predetermined load torque. Specifically, the torque limiter 53 contains an inner core and a helical spring wound around the inner core, and the load torque is caused by the dynamic friction force produced between the spring and the inner core when the spring slides on the inner core.

When the spring starts sliding, the spring has a predetermined amount of spring force. However, when the rotation of the separation roller 5 stops, the spring force is consumed and causes the return behavior of the separation roller 5. Another factor that causes the return behavior of the separation roller 5 is the rigidity of a configuration for holding the separation roller 5.

Figure 9:
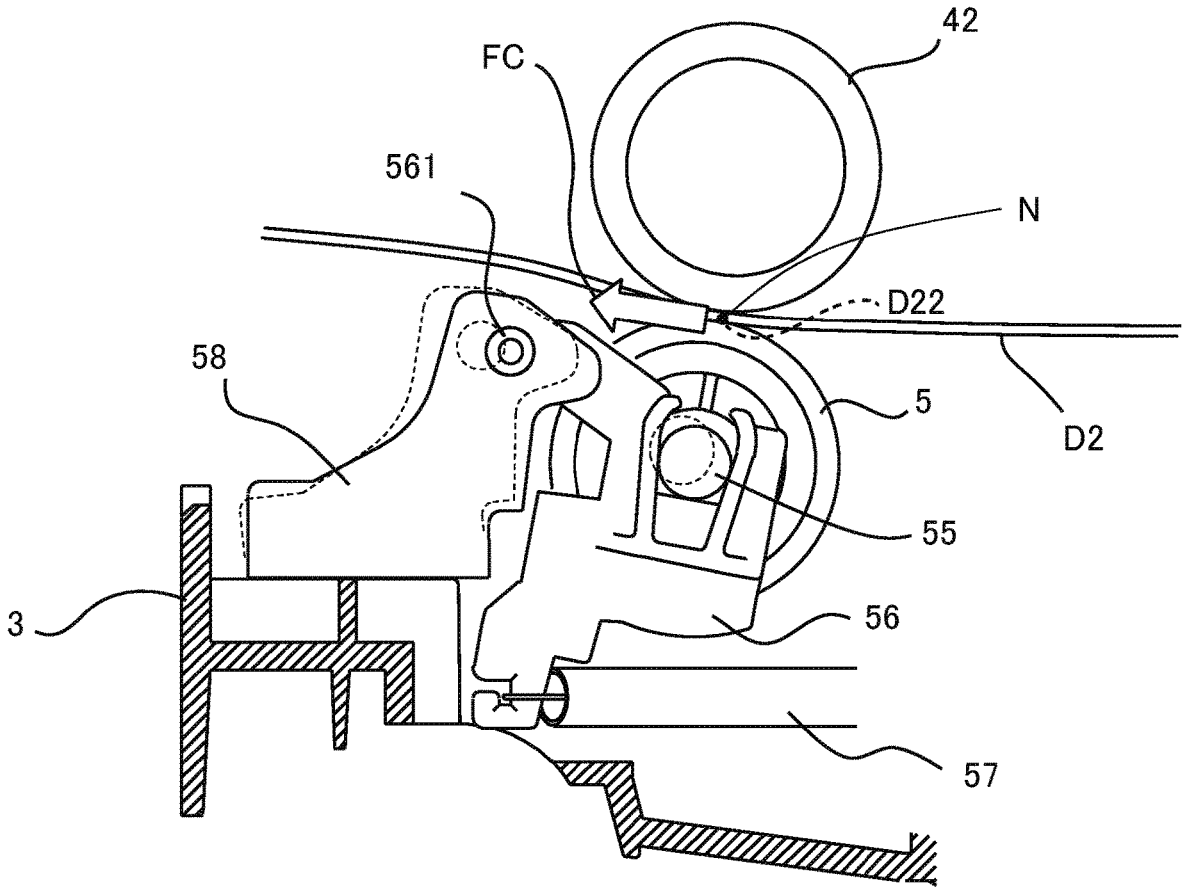
FIG. 9 is a side view illustrating a configuration for holding the separation roller.

FIG. 9 is a side view illustrating the configuration for holding the separation roller 5. As illustrated in FIG. 9, a supporting member 58 is attached to a frame 3, and supports the holder 56 such that the holder 56 can pivot on a pivot shaft 561. The holder 56 supports the shaft 55 such that the shaft does not rotate with respect to the holder 56. The holder 56 is urged by the spring 57 such that the feed roller 42 is in pressure contact with the separation roller 5.

As described above, when the separation roller 5 is rotated by the rotation of the feed roller 42, the load torque is produced. The load torque causes a force FC in the separation nip N, and the force FC is transmitted to the separation roller 5, the shaft 55, the holder 56, the pivot shaft 561, and the supporting member 58. As a result, as indicated by a broken line of FIG. 9, the supporting member 58 or the frame 3 that supports the supporting member 58 is displaced downstream in the conveyance direction.

With this displacement, the position of the separation nip N is also moved downstream in the conveyance direction, and the leading edge D22 of the second document D2 fed together with the first document D1 enters the separation nip N that is moved. When the trailing edge D1*t* of the first document D1 passes through the separation nip N, the force FC caused by the load torque disappears and the above-described displacement is removed.

As a result, the supporting member 58 or the frame 3 that supports the supporting member 58, displaced as indicated by the broken line of FIG. 9, returns to its original position due to its rigidity; and the leading edge D22 of the second document D2 is pushed back (conveyed upstream) in the conveyance direction.

Figure 10:
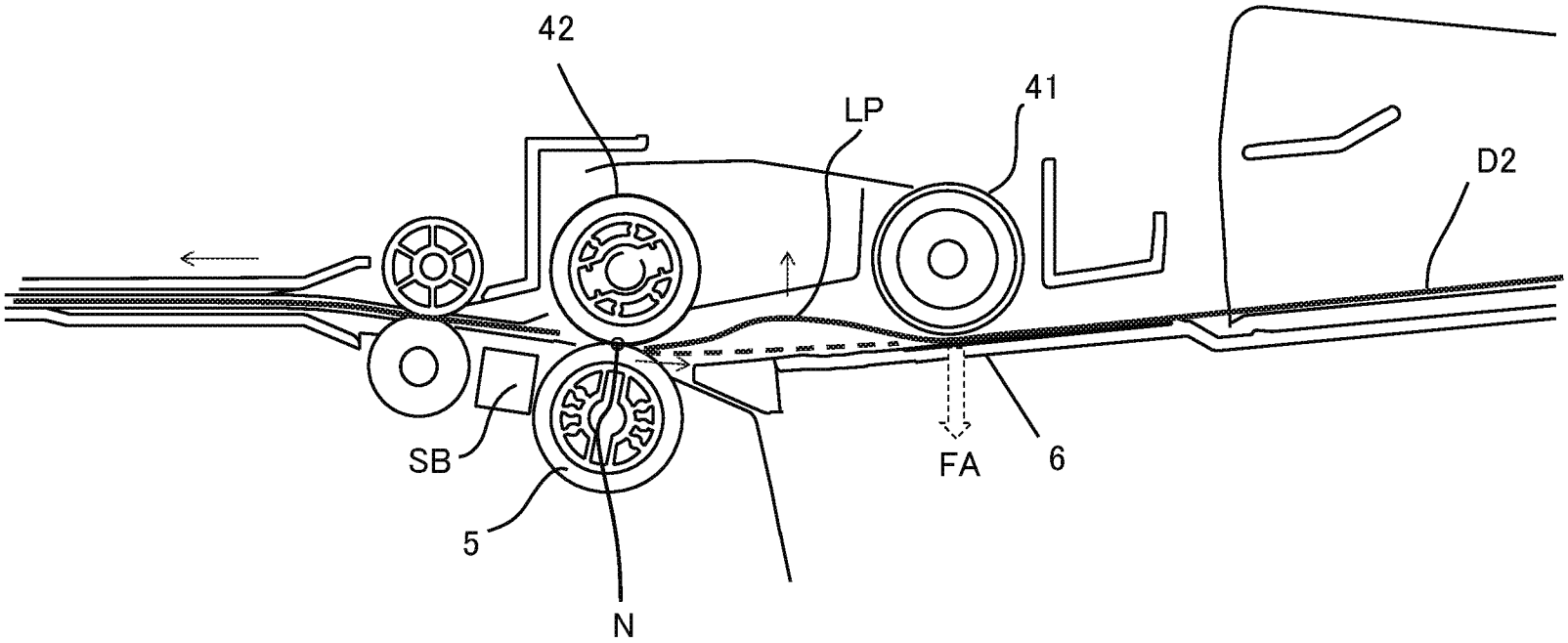
FIG. 10 is a sectional view illustrating a loop formed in a document.

In the above-described first mode, when the trailing edge D1*t* of the first document D1 passes through the separation nip N, the pickup roller 41 is in contact with the second document D2. In this manner, the second document D2 is retained by the pressing force FA applied by the pickup roller 41. Thus, when the separation roller 5 performs the return behavior, a loop LP is formed in the second document D2, as illustrated in FIG. 10. The loop LP is formed between the separation nip N and an abutment point between the second document D2 and the pickup roller 41.

In particular, in a case where the documents on the document tray 6 are thin sheets or narrow sheets, the loop LP is formed in a plurality of overlapping documents. Since the second document D2 and a document following the second document D2 are fed with the loop LP being formed, the loop LP grows every time each document is fed. If the loop LP grows larger than a predetermined size, and a document with the loop LP is fed, the document becomes unstable when fed, and causes failure in conveyance of documents, such as jamming, damage to the documents, and abnormal sound. Thus, in the present embodiment, the ADF control unit 200 can execute a second mode instead of the first mode, in the feeding control of Step S7 of FIG. 4.

In both of the first and the second modes, a circumferential speed of the pickup roller 41 is set at a first speed, and a circumferential speed of the feed roller 42 is set at a second speed. In addition, in both of the first and the second modes, the circumferential speed of the pickup roller 41 is equal to the circumferential speed of the feed roller 42.

Since the loop of the second document D2 caused by the return behavior of the separation roller 5 is easily formed in a thin sheet or a narrow sheet, it is preferable that the first mode be selected for feeding a plain sheet or a thick sheet and the second mode be selected for feeding a thin sheet or a narrow sheet. With this selection, the failure in conveyance of documents and the damage to the documents can be reduced while the productivity is kept as much as possible.

For example, the ADF 20 of the present embodiment executes the first mode in a case where a document having a first grammage is fed, and executes the second mode in a case where a document having a second grammage smaller than the first grammage is fed. The second grammage may be 50 g/m$^2$ or less. Alternatively, the ADF 20 executes the first mode in a case where a document having a first length in the width direction orthogonal to the conveyance direction is fed, and executes the second mode in a case where a document having a second length shorter than the first length in the width direction is fed. The second length may be 100 mm or less.

Second Mode

Figure 11:
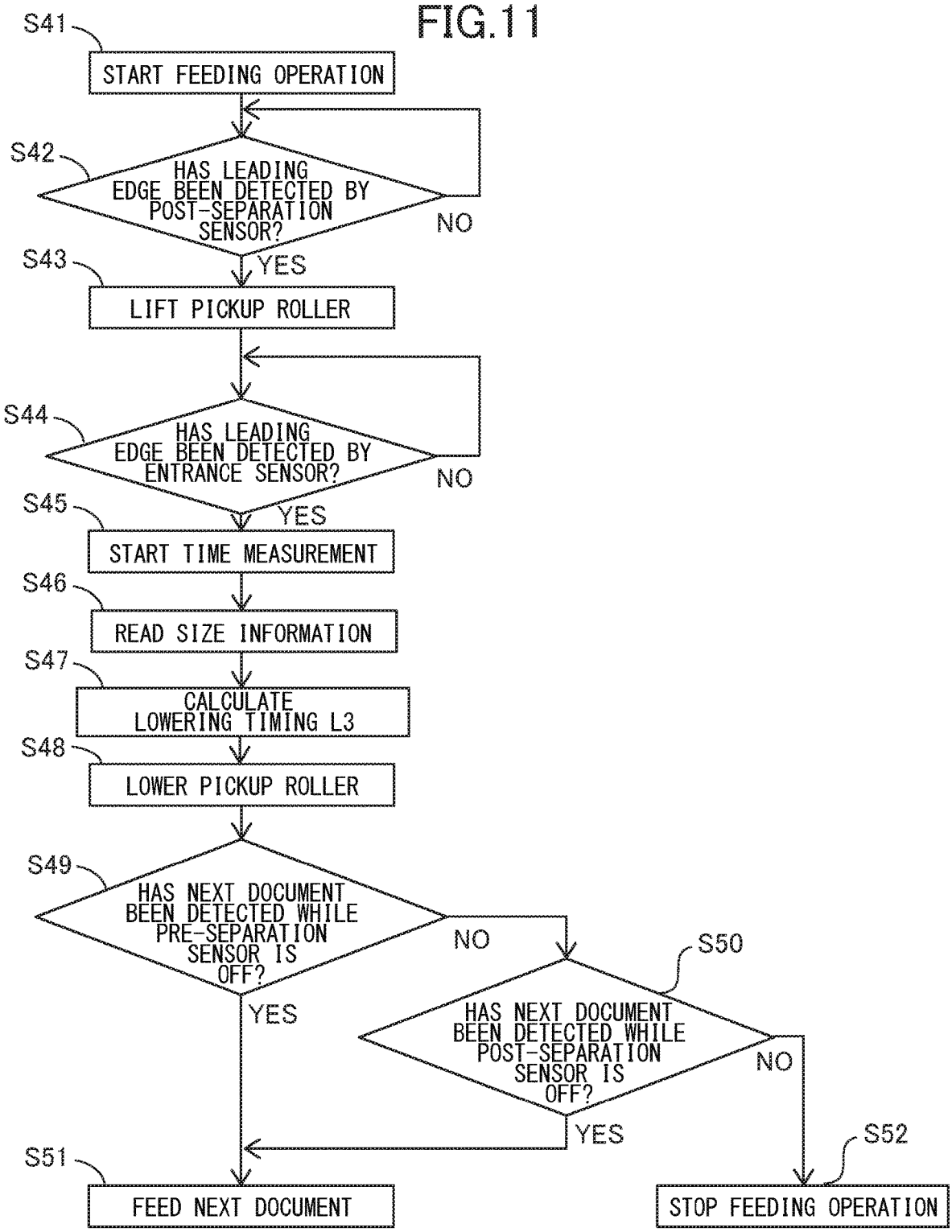
FIG. 11 is a flowchart illustrating processes of a second mode.

Next, the second mode will be described with reference to FIGS. 11 to 13. Since the steps S41 to S46 and S48 to S52 of the flowchart of FIG. 11 are the same as the steps S21 to S26 and S28 to S32 of the flowchart of FIG. 5, the description thereof will be omitted. In Step S46 of FIG. 11, the ADF control unit 200 reads size information on the first document D1 that is temporarily stored in the RAM 802. Then the ADF control unit 200 calculates a lowering timing L3 for lowering the pickup roller 41 based on the size information (Step S47).

The lowering timing L3 is a point of time at which a second time longer than the first time has elapsed since the start of the time measurement in Step S45. That is, the lowering timing L3 calculated in Step S47 of FIG. 11 is later than the lowering timing L2 calculated in Step S27 of FIG. 5.

The lowering timing L3 is a predicted timing at which the trailing edge D1*t* of the first document D1 will pass through the separation nip N. At the lowering timing L3, the ADF control unit 200 controls the lifting-and-lowering motor M2, and starts to lower (move) the pickup roller 41 from the separation position toward the feed position (Step S48).

Figure 12:
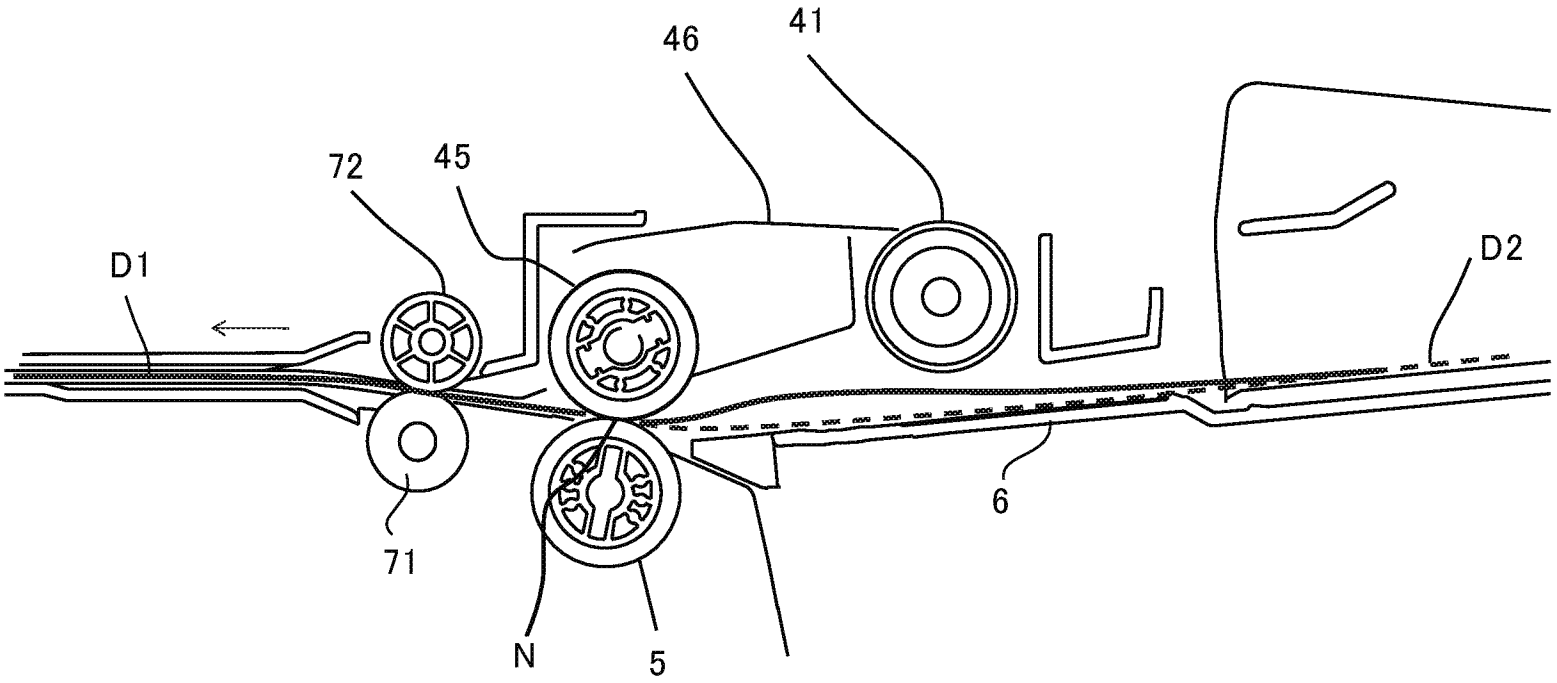
FIG. 12 is a sectional view for illustrating a timing for lowering the pickup roller.

As illustrated in FIG. 12, at the lowering timing L3, the pickup roller 41 is located at the separation position, separated more from the document tray 6 than the feed position. Thus, when the trailing edge D1*t* of the first document D1 passes through the separation nip N, the pickup roller 41 is separated from the second document D2, and is not retaining the second document D2.

Thus, even when the second document D2 is fed together with the first document D1, the above-described loop caused by the return behavior of the separation roller 5 is not formed in the second document D2. As a result, the document becomes stable when fed, and the failure in conveyance of documents, such as jamming, the damage to the documents, and the abnormal sound can be reduced.

Figure 13:
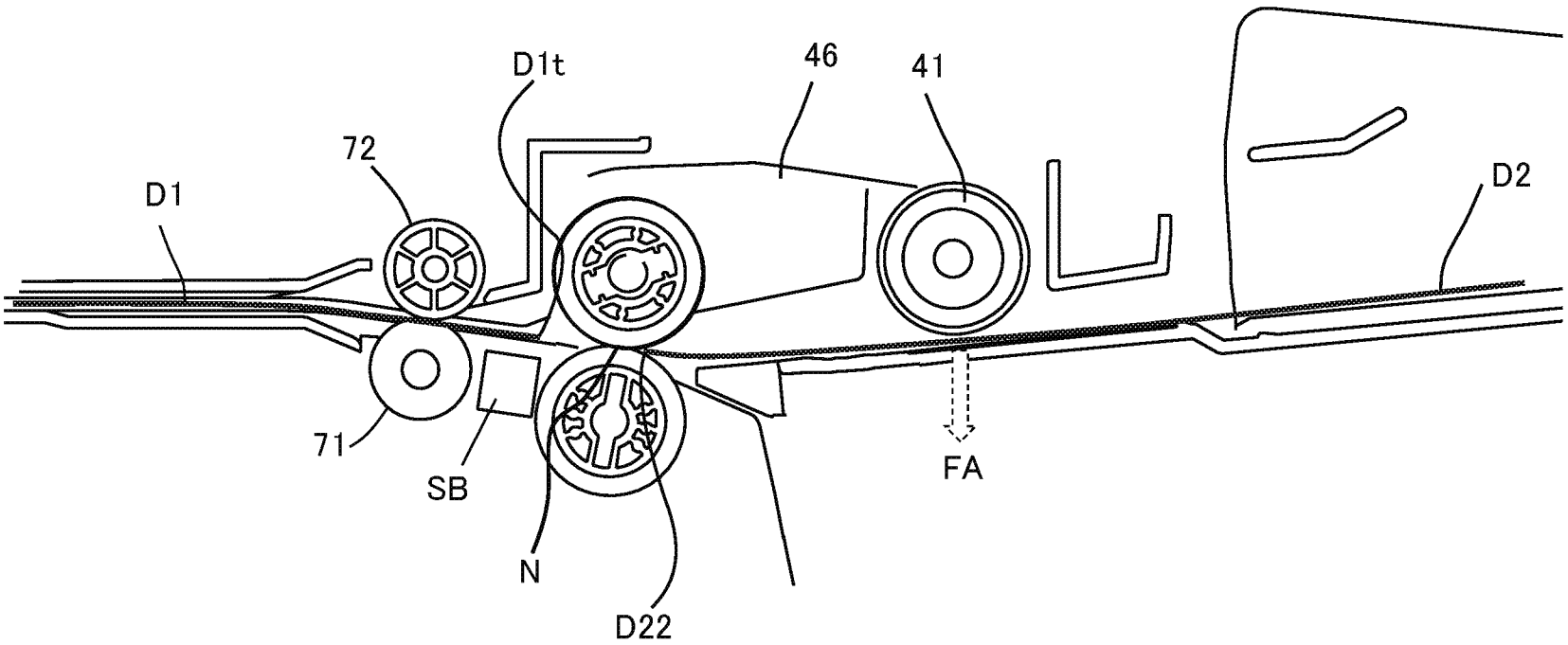
FIG. 13 is a sectional view for illustrating the timing for lowering the pickup roller.

As illustrated in FIG. 13, if the ADF control unit 200 starts to lower the pickup roller 41 from the separation position toward the feed position at the lowering timing L3, the pickup roller 41 abuts against the second document D2 in a state where the trailing edge D1*t* of the preceding first document D1 is located in the vicinity of the post-separation sensor SB. More specifically, the pickup roller 41 abuts against the second document D2 in a state where the trailing edge D1*t* of the preceding first document D1 is located slightly upstream from the post-separation sensor SB in the conveyance direction. At this time, the wavy motion of the leading edge D22 of the second document D2, caused by the return behavior of the separation roller 5, has already disappeared.

In this manner, when the trailing edge D1*t* of the first document D1 is detected by the post-separation sensor SB, the pickup roller 41 is in contact with the second document D2. Thus, the second document D2 can be fed at a timing at which the trailing edge D1*t* of the first document D1 passes the post-separation sensor SB. As a result, the interval (at which the document is conveyed) between the first document D1 and the second document D2 can be reduced and the throughput can be increased, compared to a case where the ADF control unit 200 starts to lower the pickup roller 41 from the separation position toward the feed position at a timing at which the trailing edge D1*t* of the first document D1 passes the post-separation sensor SB. Consequently, the productivity by the second mode can be made closer to the productivity by the first mode.

Second Embodiment

Next, a second embodiment of the present invention will be described. In the second embodiment, the feeding unit and the feeding control of the first embodiment are changed. Thus, the same components as those of the first embodiment are omitted in the drawings, or described with the same symbols given to the drawings.

Feeding Unit

Figure 14:
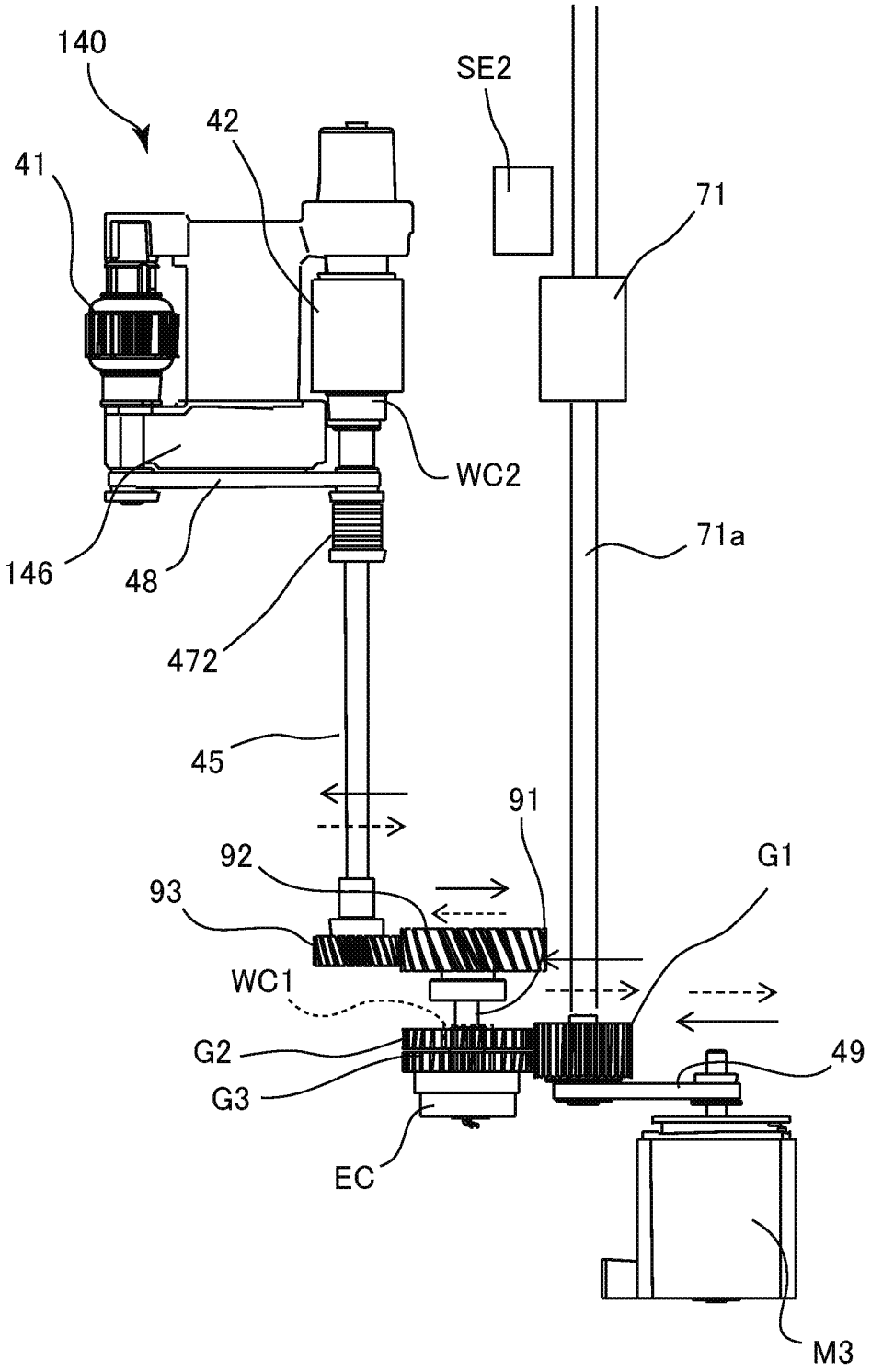
FIG. 14 is a plan view illustrating a feeding unit of a second embodiment.

As illustrated in FIG. 14, a feeding unit 140 of the second embodiment lifts and lowers the pickup roller 41 by the forward and reverse rotation of the conveyance motor M3, unlike the first embodiment that lifts and lowers the pickup roller 41 by the cam.

The driving force from the conveyance motor M3 is transmitted to a rotation shaft 71*a* of the drawing roller 71 via a belt member 49. A gear G1 is fixed to the rotation shaft 71*a*, and meshes with gears G2 and G3. The gear G2 is fixed to a countershaft 91 via a one-way clutch WC1, and the gear G3 is fixed to the countershaft 91 via an electromagnetic clutch EC.

In addition, a gear 92 is fixed to the countershaft 91, and meshes with a gear 93 fixed to the feed roller shaft 45. The feed roller 42 is fixed to the feed roller shaft 45 via a one-way clutch WC2, and a holder unit 146 is pivotably supported by the feed roller shaft 45. The holder unit 146 and the feed roller shaft 45 are coupled with each other via a coil spring 472. Thus, after the pickup roller 41 abuts against a document stacked on the document tray 6, the pickup roller 41 is pressed against the document by the coil spring 472.

The holder unit 146 serves as a supporting portion, and supports the pickup roller 41 such that the pickup roller 41 can rotate. The driving force from the feed roller shaft 45 is transmitted to the pickup roller 41 via a belt member 48.

A solid line arrow of FIG. 14 indicates a rotational direction of a corresponding rotation shaft, viewed from above and obtained when the conveyance motor M3 rotates in a forward direction. In addition, a broken line arrow of FIG. 14 indicates a rotational direction of a corresponding rotation shaft, viewed from above and obtained when the conveyance motor M3 rotates in a reverse direction. In the following description, a rotational direction indicated by the solid line arrow is defined as a forward-rotation direction in which a corresponding rotation shaft and roller rotates, and a rotational direction indicated by the broken line arrow is defined as a reverse-rotation direction in which a corresponding rotation shaft and roller rotates.

The one-way clutch WC1 transmits the forward-rotation direction torque of the gear G2 to the countershaft 91, but does not transmit the reverse-rotation direction torque of the gear G2 to the countershaft 91. The one-way clutch WC2 transmits the forward-rotation direction torque of the feed roller shaft 45 to the feed roller 42, but does not transmit the reverse-rotation direction torque of the feed roller shaft 45 to the feed roller 42.

The electromagnetic clutch EC does not transmit the torque of the gear G3 to the countershaft 91 in an OFF state in which no current flows in the electromagnetic clutch EC, but transmits the reverse-rotation direction torque of the gear G3 to the countershaft 91 in an ON state in which current flows in the electromagnetic clutch EC. Thus, the electromagnetic clutch EC is disposed in a driving-force transmission path between the conveyance motor M3 and the holder unit 146, and transitions to the ON state that is a transmission state, and to the OFF state that is a cutoff state. The electromagnetic clutch EC transmits the driving force from the conveyance motor M3 to the holder unit 146 in the ON state; and cuts off the driving force applied from the conveyance motor M3 to the holder unit 146, in the OFF state.

The pickup roller 41 and the feed roller 42 are disposed upstream in the conveyance path, whereas the drawing roller 71 is disposed downstream in the conveyance path. Thus, when the conveyance motor M3 rotates in the forward-rotation direction, the pickup roller 41 and the feed roller 42 rotate in a direction in which a document is conveyed downstream in the conveyance direction. The drawing roller 71 rotates in a direction in which the document is conveyed upstream in the conveyance direction.

In addition, when the conveyance motor M3 rotates in the reverse-rotation direction in a state where the electromagnetic clutch EC is in the ON state, the drawing roller 71 rotates in a direction in which a document would be conveyed downstream in the conveyance direction. In this case, the one-way clutch WC2 causes the feed roller 42 not to rotate, or to be rotated by the movement of the document. When the feed roller shaft 45 rotates in the reverse-rotation direction, the coil spring 472 serves as a spring clutch, and pivots the holder unit 146 and the pickup roller 41 upward against the weight of the holder unit 146 and the pickup roller 41.

Control System

Figure 15:
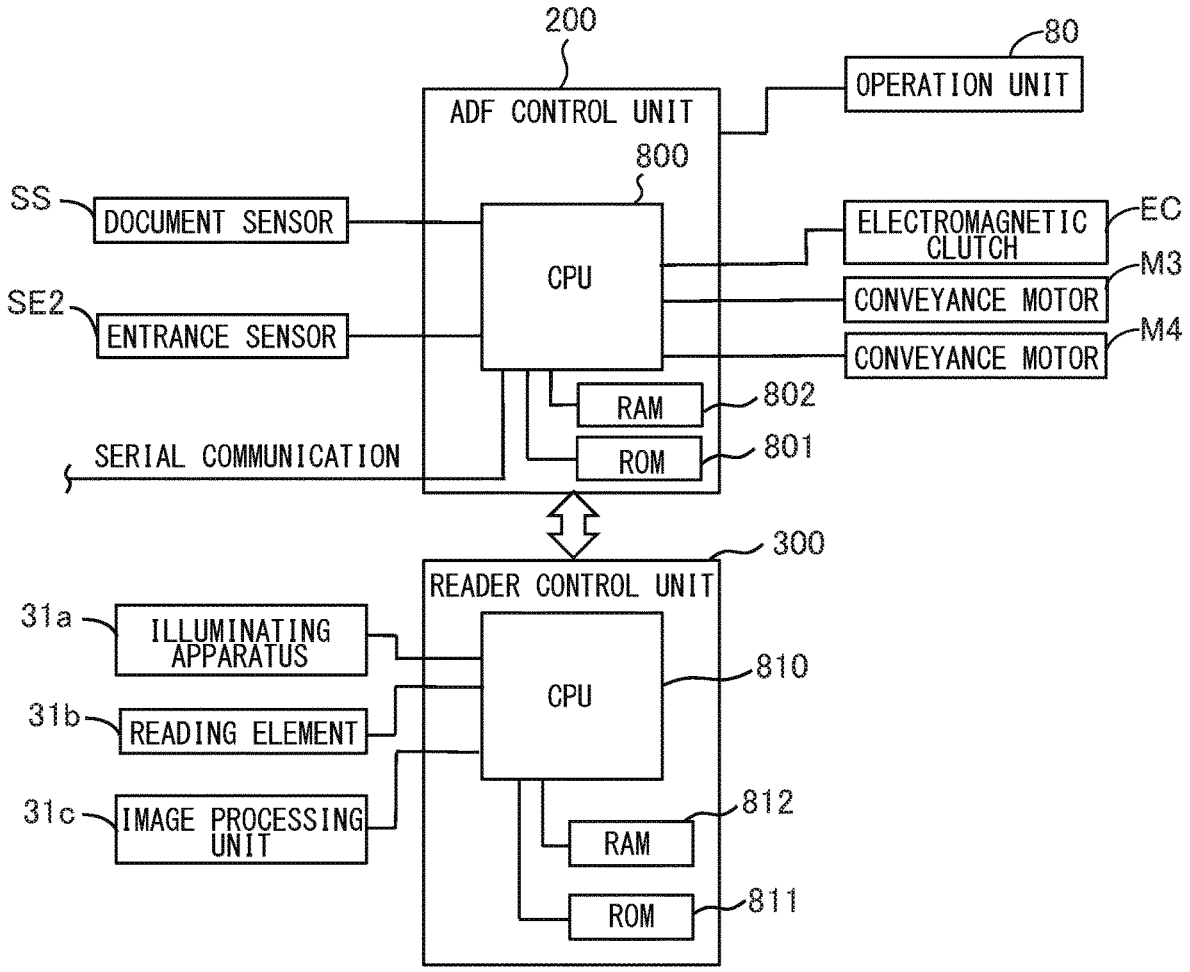
FIG. 15 is a block diagram illustrating a control system of the second embodiment.

FIG. 15 is a block diagram illustrating a control system of the present embodiment. In the control system of the present embodiment, the electromagnetic clutch is additionally disposed, and the sheet surface sensor, the pre-separation sensor, the post-separation sensor, the lifter motor, and the lifting-and-lowering motor illustrated in FIG. 3 and included in the control system of the first embodiment are not used. In the present embodiment, the document tray 6 is neither lifted nor lowered, and is fixed to the tray supporting member 61 (see FIG. 1). An entrance sensor SE2 is disposed slightly upstream from the drawing roller 71 in the conveyance direction, and detects a document that is being conveyed. That is, the entrance sensor SE2 serves as a detection portion, and detects a document at the position positioned downstream from the separation nip N in the conveyance direction.

In the conveyance sequence of the ADF 20 of the present embodiment, a document is set and a job is started, as in the first embodiment (see Step S1 and S2 of FIG. 4). However, after the start of the job, the lifter is not driven, and the feeding control is immediately started. The feeding control is executed selectively in a later-described third mode or fourth mode. Either the third mode or the fourth mode is selected by a user operating the operation unit 80 or an external computer before the job is given. When the job is given, a selected mode will be executed.

Third Mode

Figure 16:
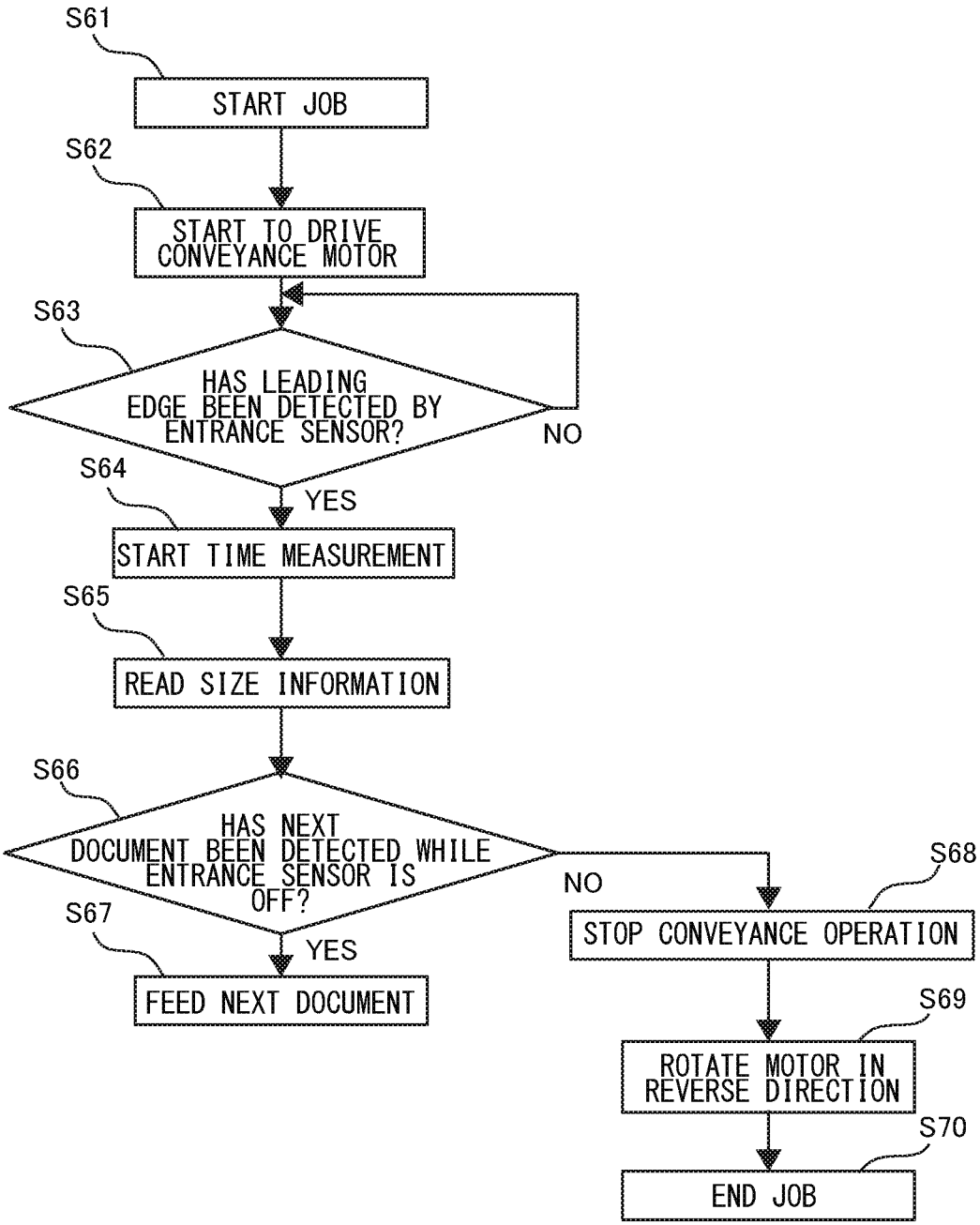
FIG. 16 is a flowchart illustrating processes of a third mode.
Figure 17:
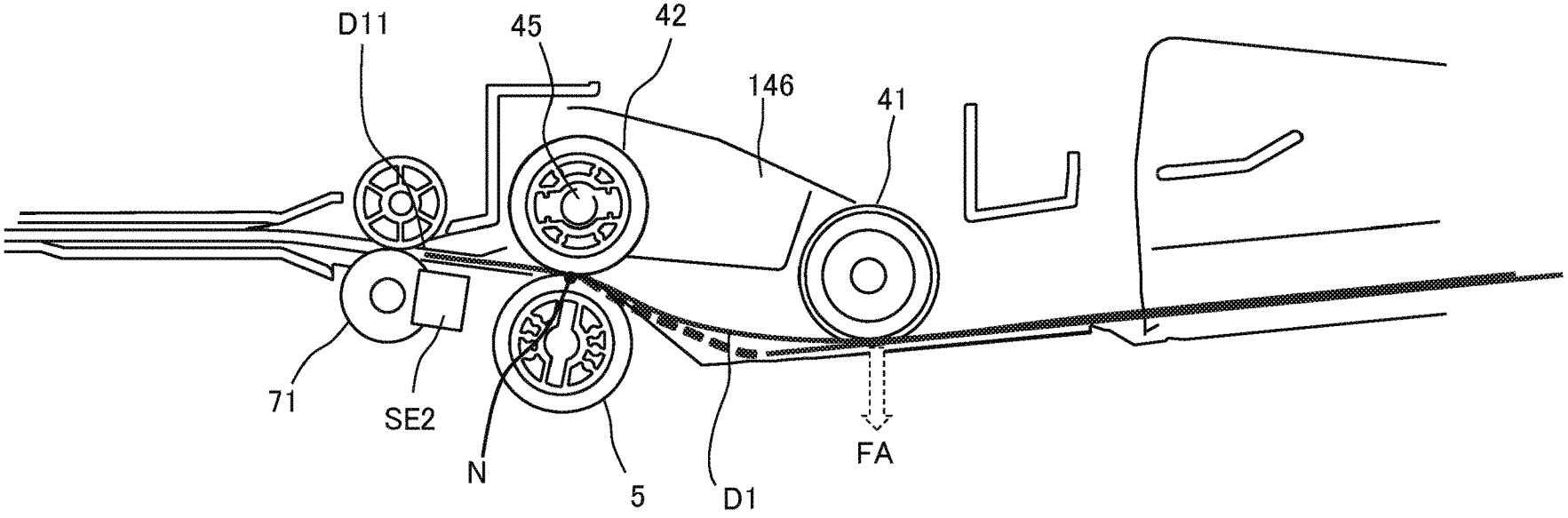
FIG. 17 is a sectional view illustrating the pickup roller kept at a feed position.

First, the third mode will be described with reference to FIGS. 16 and 17. As illustrated in FIG. 16, in the third mode, when the job is started (Step S61), the ADF control unit 200 drives the conveyance motor M3 in the forward-rotation direction (Step S62). When the conveyance motor M3 is driven in the forward-rotation direction, the pickup roller 41 is lowered from the separation position to the feed position, and feeds the first document D1 on the document tray 6, as illustrated in FIG. 17.

The pickup roller 41 is pressed against the first document D1 by a pressing force FA, which is produced by the spring force of the coil spring 472 and the weight of the pickup roller 41 and the holder unit 146. The first document D1 is conveyed by the frictional force caused by the pressing force FA and applied between the pickup roller 41 and the first document D1.

If only the first document D1 is not fed, and other documents below the first document D1 are fed together with the first document D1, the first document D1 is separated from the others one by one in the separation nip N and conveyed. Then, the ADF control unit 200 determines whether the leading edge D11 of the first document D1 is detected by the entrance sensor SE2 (Step S63). If the leading edge D11 of the first document D1 is detected (Step S63: YES), it can be regarded that the leading edge D11 has reached the drawing roller 71. Thus, the ADF control unit 200 drives the conveyance motor M3 in the reverse-rotation direction in a state where the electromagnetic clutch EC is in the OFF state. With this operation, the driving force is not transmitted to the feed roller shaft 45, and the first document D1 is conveyed in the conveyance direction by the drawing roller 71 in a state where the pickup roller 41 remains positioned at the feed position.

At this point of time, the ADF control unit 200 starts time measurement (Step S64). Note that the ADF control unit 200 may measure the conveyance distance of the first document D1, instead of measuring time. Then the ADF control unit 200 reads size information on the first document D1 that is temporarily stored in the RAM 802 (Step S65), and drives the drawing roller 71 so that the drawing roller 71 rotates for conveying the first document D1 by a predetermined distance.

If the trailing edge D1*t* of the first document D1 passes the entrance sensor SE2 and the entrance sensor SE2 turns off, then the ADF control unit 200 determines whether the second document D2 is detected by the document sensor SS (Step S66). If the second document D2 is detected (Step S66: YES), then the ADF control unit 200 drives the conveyance motor M3 in the forward-rotation direction, and conveys the second document D2 (Step S67).

If the second document D2 is not detected (Step S66: NO), then the ADF control unit 200 stops the conveyance motors M3 and M4, and drives the conveyance motor M3 in the reverse-rotation direction in a state where the electromagnetic clutch EC is in the ON state (Step S68 and S69). With this operation, the pickup roller 41 is lifted to the separation position, and the ADF 20 allows other documents to be placed on the document tray 6, and completes the job (Step S70).

In the sequence of the third mode, the pickup roller 41 is always located at the feed position in the feeding operation. That is, the conveyance motor M3 and the electromagnetic clutch EC are controlled so that the pickup roller 41 is positioned at the feed position in a period of time from when the feeding of the first document D1 is started by the pickup roller 41, until when the trailing edge of the first document D1 passes through the separation nip N. Thus, the loop may be formed in the second document D2 by the return behavior of the separation roller 5 performed when the first document D1 passes through the separation nip N. Thus, in the present embodiment, the ADF control unit 200 can execute a fourth mode instead of the third mode.

In both of the third and the fourth modes, a circumferential speed of the pickup roller 41 is set at a third speed, and a circumferential speed of the feed roller 42 is set at a fourth speed. In addition, in both of the third and the fourth modes, the circumferential speed of the pickup roller 41 is equal to the circumferential speed of the feed roller 42.

Since the loop of the second document D2 caused by the return behavior of the separation roller 5 is easily formed in a thin sheet or a narrow sheet, it is preferable that the third mode be selected for feeding a plain sheet or a thick sheet and the fourth mode be selected for feeding a thin sheet or a narrow sheet. With this selection, the failure in conveyance of documents and the damage to the documents can be reduced while the productivity is kept as much as possible.

For example, the ADF 20 of the present embodiment executes the third mode when feeding a document having a third grammage, and executes the fourth mode when feeding a document having a fourth grammage smaller than the third grammage. The fourth grammage may be 50 g/m$^2$ or less. Alternatively, the ADF 20 executes the third mode when feeding a document having a third length in the width direction orthogonal to the conveyance direction, and executes the fourth mode when feeding a document having a fourth length smaller than the third length in the width direction. The fourth length may be 100 mm or less.

Fourth Mode

Figure 18:
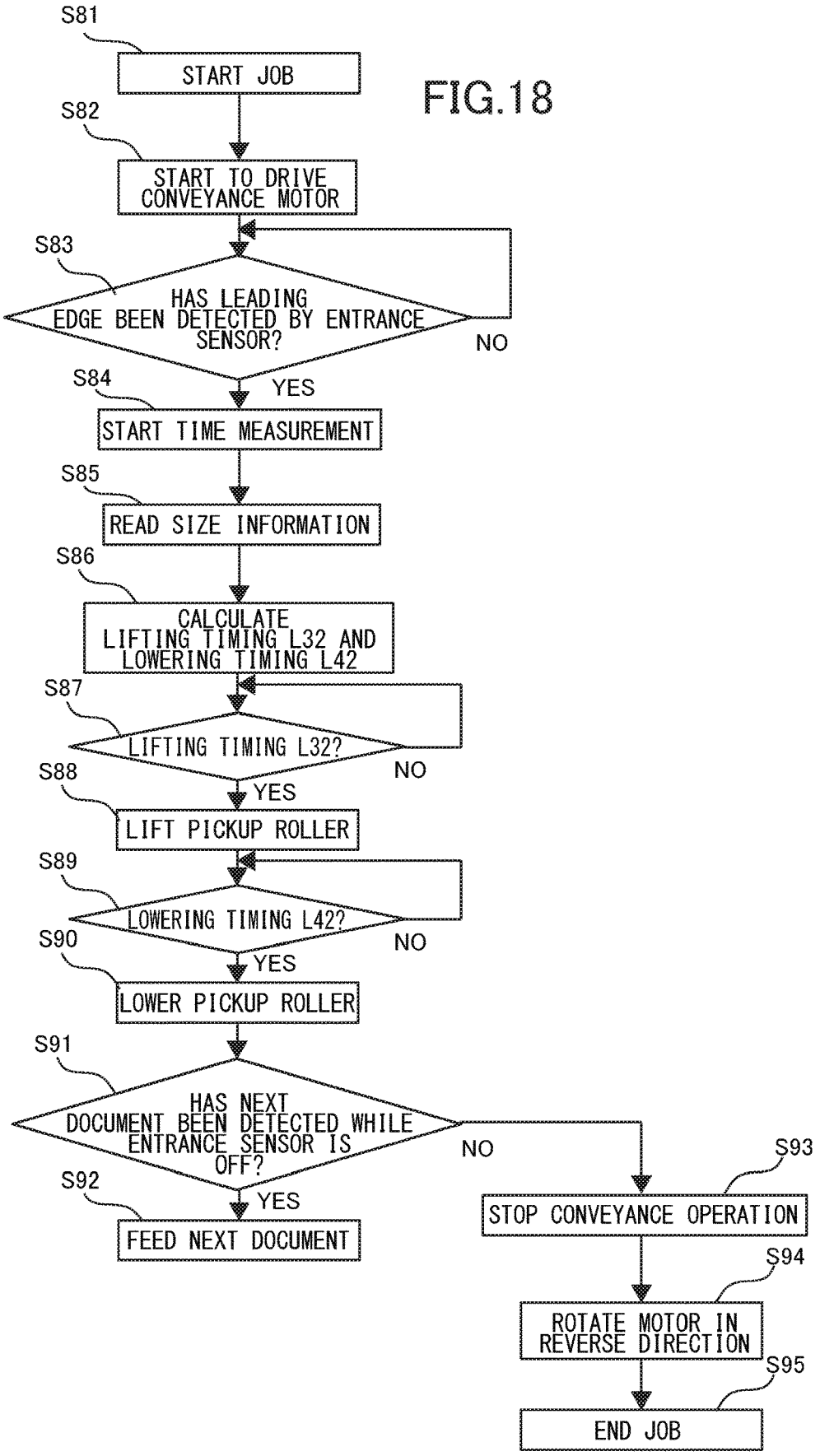
FIG. 18 is a flowchart illustrating processes of a fourth mode.

Next, the fourth mode will be described with reference to FIGS. 18 to 20. Since the steps S81 to S85 and S91 to S95 of the flowchart of FIG. 18 are the same as the steps S61 to S65 and S66 to S70 of the flowchart of FIG. 16, the description thereof will be omitted. In Step S85 of FIG. 18, the ADF control unit 200 reads size information on the first document D1. Then the ADF control unit 200 calculates a lifting timing L32 for lifting the pickup roller 41 and a lowering timing L42 for lowering the pickup roller 41 based on the size information (Step S86).

The lifting timing L32 is a point of time at which a third time has elapsed from the start of the time measurement in Step S84. In addition, the lifting timing L32 is a predicted timing at which the trailing edge D1*t* of the first document D1 will pass the pickup roller 41. The lowering timing L42 is a point of time at which a fourth time longer than the third time has elapsed from the start of the time measurement in Step S84. In addition, the lowering timing L42 is a predicted timing at which the trailing edge D1*t* of the first document D1 will pass through the separation nip N.

If the lifting timing L32 is reached (Step S87: YES), then the ADF control unit 200 sets the state of the electromagnetic clutch EC to the ON state. Since the conveyance motor M3 is driven in the reverse-rotation direction in this time, the pickup roller 41 starts to be lifted from the feed position toward the separation position, as illustrated in FIG. 19 (Step S88).

The pickup roller 41 is lifted and abuts against a housing of the ADF 20. After that, however, the driving force for the pickup roller 41 is canceled by a predetermined torque of a torque limiter (not illustrated) disposed between the gear G2 and the feed roller shaft 45. The predetermined torque serves as urging force that retains the pickup roller 41 at the separation position.

If the lowering timing L42 is reached (Step S89: YES), then the ADF control unit 200 sets the state of the electromagnetic clutch EC to the OFF state. With this operation, the urging force that urges the pickup roller 41 upward disappears, and the pickup roller 41 and the holder unit 146 fall due to their own weight. Specifically, the pickup roller 41 starts to be lowered (moved) from the separation position toward the feed position (Step S90).

Figure 19:
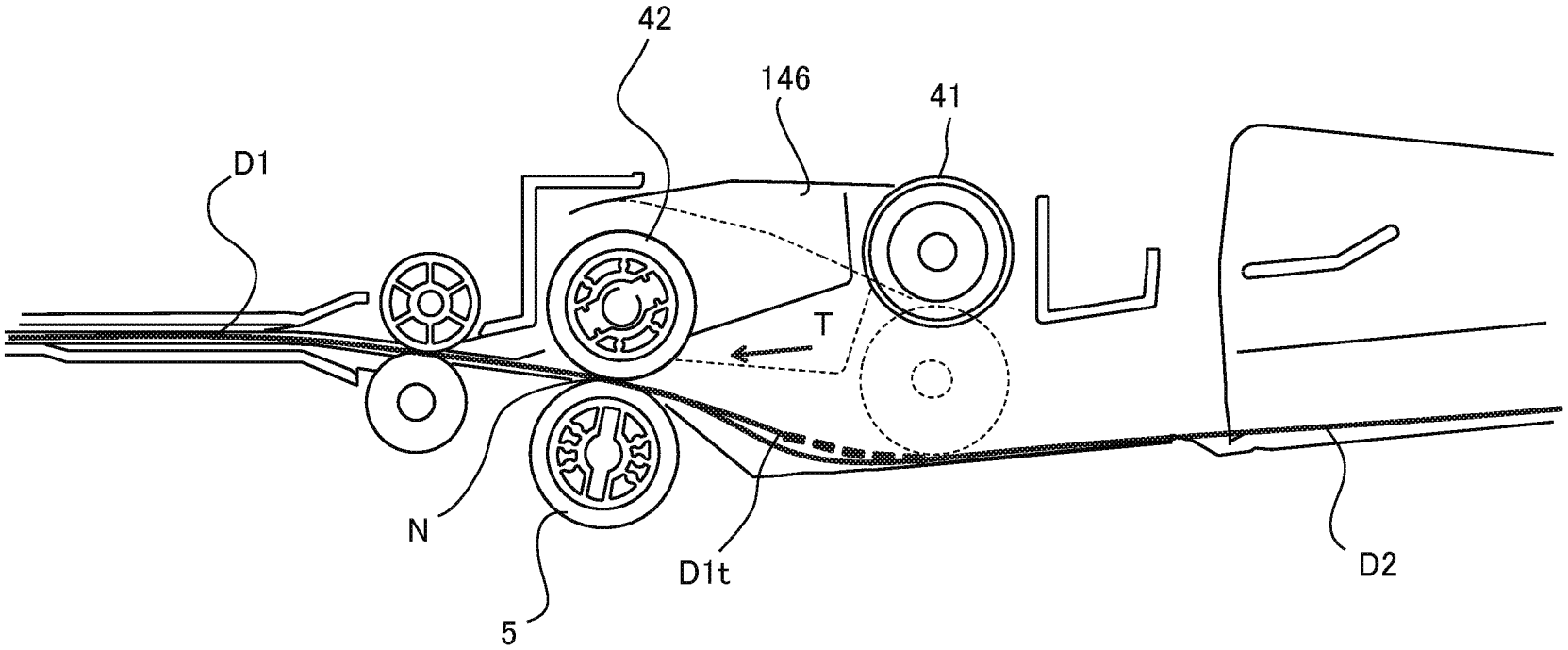
FIG. 19 is a sectional view for illustrating a timing for lifting the pickup roller.
Figure 20:
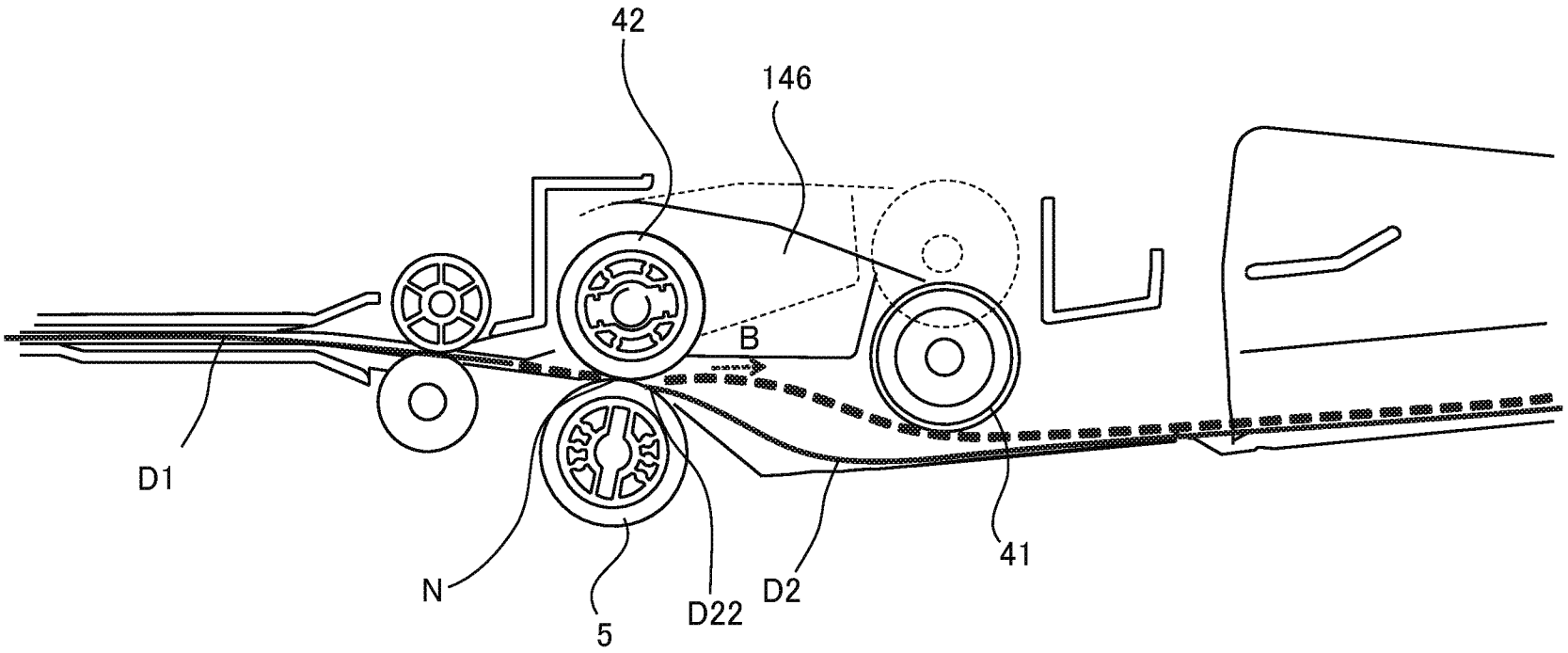
FIG. 20 is a sectional view for illustrating a timing for lowering the pickup roller.

As illustrated in FIG. 19 at the lowering timing L42 for lowering the pickup roller 41, the pickup roller 41 is located at the separation position, separated more from the document tray 6 than the feed position. Thus, when the trailing edge D1*t* of the first document D1 passes through the separation nip N, the pickup roller 41 is separated from the second document D2, and is not retaining the second document D2.

Thus, even if the leading edge D22 of the second document D2 is pushed back toward a direction indicated by an arrow B, due to the return behavior of the separation roller 5, no loop is formed in the second document D2. As a result, the document becomes stable when fed, and the failure in conveyance of documents, such as jam, the damage to the documents, and the abnormal sound can be reduced.

After the ADF control unit 200 starts to lower the pickup roller 41 from the separation position toward the feed position at the lowering timing L42, the pickup roller 41 abuts against the second document D2 before the trailing edge D1*t* of the first document D1 reaches the entrance sensor SE2. Thus, when the trailing edge D1*t* of the first document D1 is detected by the entrance sensor SE2, the second document D2 can be immediately fed by the pickup roller 41.

As a result, compared to a case where the ADF control unit 200 starts to lower the pickup roller 41 from the separation position toward the feed position at a timing at which the trailing edge D1*t* of the first document D1 passes the entrance sensor SE2, the second document D2 can be fed early by a time necessary to lower the pickup roller 41 and stabilize the same. As a result, the interval (at which the document is conveyed) between the first document D1 and the second document D2 can be reduced and the throughput can be increased. Consequently, the productivity by the fourth mode can be made closer to the productivity by the third mode.

Modifications

The first and the second modes of the first embodiment and the third and the fourth modes of the second embodiment may not be selected by a user, and may be automatically selected depending on the type or the size of a document. For example, those modes may be automatically selected, depending on a detection result by a sensor disposed on the document tray 6 to detect the size of documents.

In the above-described embodiments, the rotary members, such as the pickup roller 41, the feed roller 42, the separation roller 5, and the drawing roller 71, may include not a roller but a belt. In the second embodiment, another clutch member, such as a hydraulic clutch, may be used instead of the electromagnetic clutch EC.

In addition, although the embodiments have been described for the case where the electrophotographic printer 100 is used, the present invention is not limited to this. For example, the present invention may also be applied to an ink-jet image forming apparatus that forms images on sheets by injecting ink from a nozzle. In addition, the sheet feeding apparatus of the present invention may be any of the ADF 20, the image reading apparatus 10, and the printer 100. The above-described feeding control may be executed not by the ADF control unit 200, but by a control unit of the printer body 50.

The present invention may be embodied by providing a program, which achieves one or more functions of the above-described embodiments, to a system or an apparatus via a network or a storage medium, and by causing one or more processors of the system or the apparatus to read and execute the program. In addition, the present invention may be embodied by a circuit (for example, an ASIC) that achieves one or more functions.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-107290, filed Jun. 7, 2019, which is hereby incorporated by reference herein in its entirety.

What is claimed is:

1. A sheet feeding apparatus comprising:

a stacking portion on which a sheet is stacked;

a rotary feeding member configured to feed the sheet stacked on the stacking portion;

a rotary conveyance member configured to convey the sheet, fed by the rotary feeding member, in a conveyance direction;

a rotary separation member configured to form a separation nip together with the rotary conveyance member, and configured to be rotated by rotation of the rotary conveyance member with a predetermined load torque in a case where the sheet is conveyed by the separation nip in the conveyance direction, the separation nip being configured to separate the sheet from another sheet;

a supporting portion configured to rotatably support the rotary feeding member;

a driving source configured to drive the supporting portion such that the rotary feeding member moves between a first position and a second position, the first position being a position at which the rotary feeding member abuts against the sheet stacked on the stacking portion, the second position being a position at which the rotary feeding member is separated from the sheet stacked on the stacking portion;

a detection portion configured to detect the sheet in a position positioned downstream of the separation nip; and a control unit configured to control the driving source, wherein the control unit is configured to execute a first mode and a second mode, wherein in the first mode, the control unit is configured to control the driving source such that the rotary feeding member starts to move toward the first position based on an elapse of a first time since the detection portion detected a leading edge of the sheet, and position the rotary feeding member at the first position when a trailing edge of the sheet passes through the separation nip, and wherein in the second mode, the control unit is configured to control the driving source such that the rotary feeding member starts to move toward the first position based on an elapse of a second time longer than the first time since the detection portion detected the leading edge of the sheet, and position the rotary feeding member at a position separated more from the stacking portion than the first position when the trailing edge of the sheet passes through the separation nip.

2. The sheet feeding apparatus according to claim 1, wherein in the second mode, the control unit controls the driving source such that the rotary feeding member starts to move toward the first position when the trailing edge of the sheet passes through the separation nip.

3. The sheet feeding apparatus according to claim 1, wherein in the first mode and the second mode, the control unit controls the driving source such that the rotary feeding member moves from the first position to the second position after the leading edge of the sheet passes through the separation nip.

4. The sheet feeding apparatus according to claim 1, wherein in both of the first mode and the second mode, the control unit sets a circumferential speed of the rotary feeding member at a first speed, and sets a circumferential speed of the rotary conveyance member at a second speed.

5. The sheet feeding apparatus according to claim 1, wherein the control unit executes the first mode in a case where a sheet having a first grammage is fed, and executes the second mode in a case where a sheet having a second grammage smaller than the first grammage is fed.

6. The sheet feeding apparatus according to claim 1, wherein the control unit executes the first mode in a case where a sheet having a first length in a width direction orthogonal to the conveyance direction is fed, and executes the second mode in a case where a sheet having a second length shorter than the first length in the width direction is fed.

7. The sheet feeding apparatus according to claim 1, further comprising a torque limiter configured to apply a load torque to the rotary separation member in a case where the rotary separation member is rotated by rotation of the rotary conveyance member.

8. The sheet feeding apparatus according to claim 1, further comprising a clutch member disposed in a driving-force transmission path between the driving source and the supporting portion and configured to transition between a transmission state and a cutoff state, the transmission state being a state in which driving force is transmitted from the driving source to the supporting portion, the cutoff state being a state in which the driving force from the driving source to the supporting portion is cut off, wherein the supporting portion is moved toward the second position by the driving force from the driving source in a case where the clutch member is in the transmission state, and moves toward the first position due to a weight of the supporting portion in a case where the clutch member is in the cutoff state.

9. The sheet feeding apparatus according to claim 1, further comprising a reading portion configured to read an image on the sheet fed by the rotary feeding member.

10. The sheet feeding apparatus according to claim 9, further comprising an image forming portion configured to form an image on the sheet.

11. A sheet feeding apparatus comprising:

a stacking portion on which a sheet is stacked;

a rotary feeding member configured to feed the sheet stacked on the stacking portion;

a rotary conveyance member configured to convey the sheet, fed by the rotary feeding member, in a conveyance direction;

a rotary separation member configured to form a separation nip together with the rotary conveyance member, and configured to be rotated by rotation of the rotary conveyance member with a predetermined load torque in a case where the sheet is conveyed by the separation nip in the conveyance direction, the separation nip being configured to separate the sheet from another sheet;

a supporting portion configured to rotatably support the rotary feeding member;

a driving source configured to drive the supporting portion such that the rotary feeding member moves between a first position and a second position, the first position being a position at which the rotary feeding member abuts against the sheet stacked on the stacking portion, the second position being a position at which the rotary feeding member is separated from the sheet stacked on the stacking portion;

a detection portion configured to detect the sheet in a position positioned downstream of the separation nip; and a control unit configured to control the driving source, wherein the control unit is configured to execute a third mode and a fourth mode, wherein in the third mode, the control unit is configured to control the driving source such that the rotary feeding member is positioned at the first position in a period of time from when the rotary feeding member starts to feed the sheet until when a trailing edge of the sheet passes through the separation nip, and position the rotary feeding member at the first position when the trailing edge of the sheet passes through the separation nip, and wherein in the fourth mode, the control unit is configured to control the driving source such that the rotary feeding member starts to move toward the second position based on an elapse of a third time since the detection portion detected a leading edge of the sheet, control the driving source such that the rotary feeding member starts to move toward the first position based on an elapse of a fourth time longer than the third time since the detection portion detected the leading edge of the sheet, and position the rotary feeding member at a position separated more from the stacking portion than the first position when the trailing edge of the sheet passes through the separation nip.

12. The sheet feeding apparatus according to claim 11, wherein in the fourth mode, the control unit controls the driving source such that the rotary feeding member starts to move toward the first position when the trailing edge of the sheet passes through the separation nip.

13. The sheet feeding apparatus according to claim 11, wherein in the fourth mode, the control unit controls the driving source such that the rotary feeding member is positioned at the first position in a period of time when the third time has elapsed since the leading edge of the sheet was detected by the detection portion, and wherein the trailing edge of the sheet passes the rotary feeding member when the third time has elapsed.

14. The sheet feeding apparatus according to claim 11, wherein in both of the third mode and the fourth mode, the control unit sets a circumferential speed of the rotary feeding member at a third speed, and sets a circumferential speed of the rotary conveyance member at a fourth speed.

15. The sheet feeding apparatus according to claim 11, wherein the control unit executes the third mode in a case where a sheet having a third grammage is fed, and executes the fourth mode in a case where a sheet having a fourth grammage smaller than the third grammage is fed.

16. The sheet feeding apparatus according to claim 11, wherein the control unit executes the third mode in a case where a sheet having a third length in a width direction orthogonal to the conveyance direction is fed, and executes the fourth mode in a case where a sheet having a fourth length shorter than the third length in the width direction is fed.

17. The sheet feeding apparatus according to claim 11, further comprising a torque limiter configured to apply a load torque to the rotary separation member in a case where the rotary separation member is rotated by rotation of the rotary conveyance member.

18. The sheet feeding apparatus according to claim 11, further comprising a clutch member disposed in a driving-force transmission path between the driving source and the supporting portion and configured to transition between a transmission state and a cutoff state, the transmission state being a state in which driving force is transmitted from the driving source to the supporting portion, the cutoff state being a state in which the driving force from the driving source to the supporting portion is cut off, wherein the supporting portion is moved toward the second position by the driving force from the driving source in a case where the clutch member is in the transmission state, and moves toward the first position due to a weight of the supporting portion in a case where the clutch member is in the cutoff state.

19. The sheet feeding apparatus according to claim 11, further comprising a reading portion configured to read an image on the sheet fed by the rotary feeding member.

20. The sheet feeding apparatus according to claim 19, further comprising an image forming portion configured to form an image on the sheet.

* * * * *